US005638569A

United States Patent [19]

Newell

[11] Patent Number: 5,638,569

[45] Date of Patent: Jun. 17, 1997

[54] POLYSURFACIAL MOP HEAD, AND MOP ARTICLE COMPRISING SAME

[76] Inventor: Robert D. Newell, 429 N. Main St., Roxboro, N.C. 27573

[21] Appl. No.: 310,273

[22] Filed: Sep. 21, 1994

Related U.S. Application Data

[63] Continuation-in-part of Ser. No. 922,031, Jul. 29, 1992, abandoned, which is a continuation-in-part of Ser. No. 793,854, Nov. 18, 1991, Pat. No. 5,227,228, which is a continuation-in-part of Ser. No. 471,110, Jan. 26, 1990, Pat. No. 5,066,527, which is a continuation-in-part of Ser. No. 189,484, May 2, 1988, Pat. No. 4,923,738.

[51] Int. Cl.[6] ..... A47L 13/20

[52] U.S. Cl. ..... 15/229.6; 15/228; 15/229.1; 15/229.2

[58] Field of Search ..... 15/228, 229.1, 15/229.9

[56] References Cited

U.S. PATENT DOCUMENTS

| | | | |
|---|---|---|---|
| 891,744 | 6/1908 | Stocker . | |
| 1,002,268 | 9/1911 | Hayden . | |
| 1,313,184 | 8/1919 | Hayden . | |
| 1,360,926 | 11/1920 | Glenn . | |
| 1,739,704 | 12/1929 | Yancey | 15/229.1 |
| 1,783,795 | 12/1930 | Kenner . | |
| 1,802,949 | 4/1931 | Kootz . | |
| 1,855,400 | 4/1932 | Krebs . | |
| 1,936,433 | 11/1933 | Jumoville . | |
| 1,993,215 | 3/1935 | Hoyt et al. | 300/21 |
| 2,035,130 | 3/1936 | Klawans | 300/21 |
| 2,230,101 | 1/1941 | Backemeier . | |

(List continued on next page.)

FOREIGN PATENT DOCUMENTS

| | | |
|---|---|---|
| 721174 | 12/1931 | France . |
| 924880 | 8/1947 | France . |
| 490512 | 1/1930 | Germany . |
| 109484 | 9/1917 | United Kingdom . |
| 296542 | 9/1928 | United Kingdom . |

OTHER PUBLICATIONS

"Cotton/Growth in Nonwovens, Naturally," Nonwovens Industry, Jun. 1989, pp. 26–30.

"Fibers for Nonwovens/Another Record Year for Stable Shipments," Harrison, D. Nonwovens Industry, Jun., 1989, pp. 20–24.

"Monhan's Miraculus Mopster™/the mop yarn of the 90's." The Monahan Co.

"One System . . . System 1™/The Flat Mopping Concept," Wilen Manuf. Company, GA.

"White Floor Mopping Equipment and MIpro Waste Receptacles Price List, Effective: Jan. 15, 1986" product brochure of White Mop Wringer Co., P.O. Box 277, Riveside Drive, Fultonville, NY 12072.

"New Dispenser Package Massilinn™ Cleaning Cloth", Chicopee, New Brunswick, NJ.

"More Than Just a Source", Wilen Manufacturing Company, Atlanta, GA 30315.

"Pig Almanac/Taking Cleanliness to New Heights," vol. III, No. 1, Jan., 1990 New Pig Corporation, Tipton, PA 16684.

*Primary Examiner*—Mark Spisich

*Attorney, Agent, or Firm*—Steven J. Hultquist

[57] ABSTRACT

A polysurfacial mop head suitable for use with a mop handle, including an array of strand elements secured by securement members to form a unitary mop head body of generally flat character when reposed on a planar supporting surface The mop head body is securable on a mounting assembly of the mop handle in at least two differing deployment orientations with the active mopping surface presented to said planar supporting surface comprising differing surface portions of the mop head body in the different deployment orientations of the mop head body. Also disclosed is a mop head assembly having an extended support structure which is "breakable" at a medial part thereof, so that the outer extremities of the structure pivotally distend to a relaxed condition, in which the mop head body secured to the support structure may be readily wrung out, or otherwise prepared for reuse (e.g., in dry mopping or applicator uses).

21 Claims, 12 Drawing Sheets

U.S. PATENT DOCUMENTS

| | | | |
|---|---|---|---|
| 2,231,272 | 2/1941 | Klawans | 300/21 |
| 2,239,686 | 4/1941 | Owens . | |
| 2,300,821 | 11/1942 | Weaver et al. | 300/21 |
| 2,782,441 | 2/1957 | Lipton . | |
| 3,115,658 | 12/1963 | Moss . | |
| 3,324,497 | 6/1967 | Moss . | |
| 3,425,085 | 2/1969 | Moss . | |
| 3,449,784 | 6/1969 | Moss . | |
| 3,453,677 | 7/1969 | Cutler | 15/104.94 |
| 3,520,017 | 7/1970 | Moss . | |
| 3,565,077 | 2/1971 | Glick . | |
| 3,593,359 | 7/1971 | Strauss | 15/229.8 |
| 3,711,886 | 1/1973 | Strauss | 15/229.8 |
| 3,827,099 | 8/1974 | Allaire et al. . | |
| 4,114,223 | 9/1978 | Buchanan | 15/228 |
| 4,114,224 | 9/1978 | Disko . | |
| 4,227,277 | 10/1980 | McNelley, Jr. . | |
| 4,313,774 | 2/1982 | Arthur . | |
| 4,530,130 | 7/1985 | Moss . | |
| 4,717,616 | 1/1988 | Harmon et al. . | |
| 4,750,234 | 6/1988 | Quearry et al. . | |
| 4,752,985 | 6/1988 | Quearry et al. . | |
| 4,923,738 | 5/1990 | Newell . | |
| 4,995,133 | 2/1991 | Newell | 15/229.1 |
| 5,066,527 | 11/1991 | Newell . | |

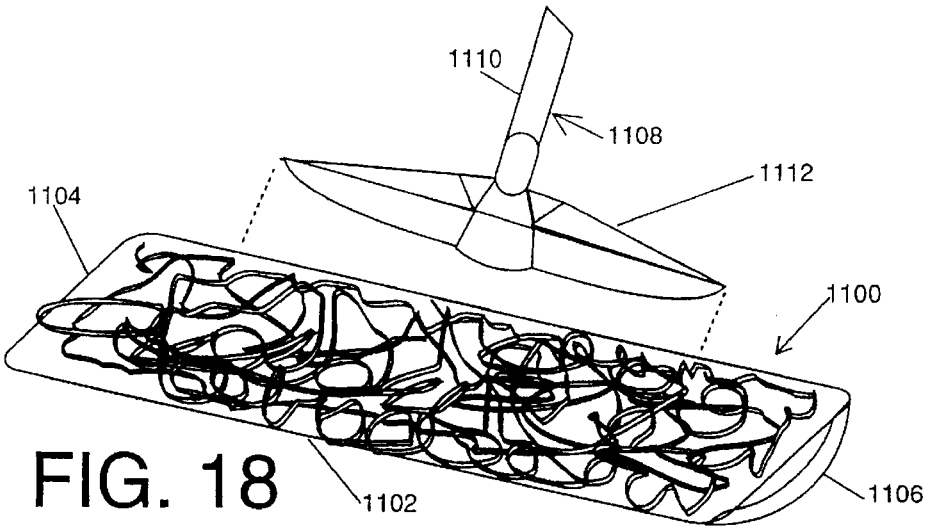
FIG. 18
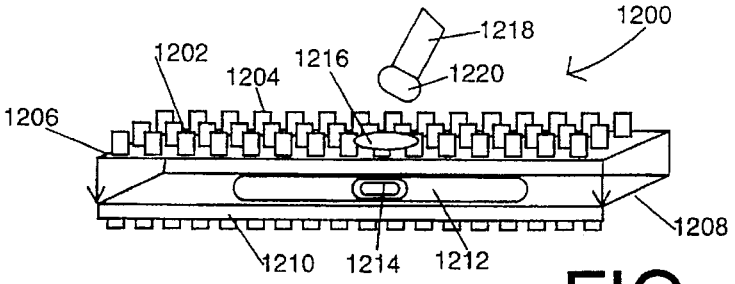
FIG. 19
FIG. 20
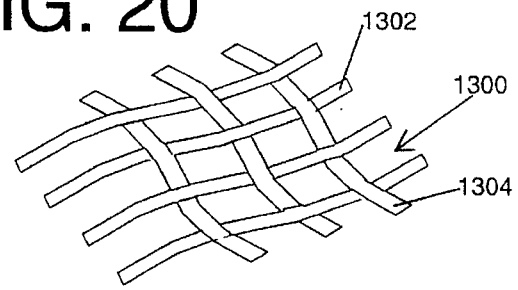
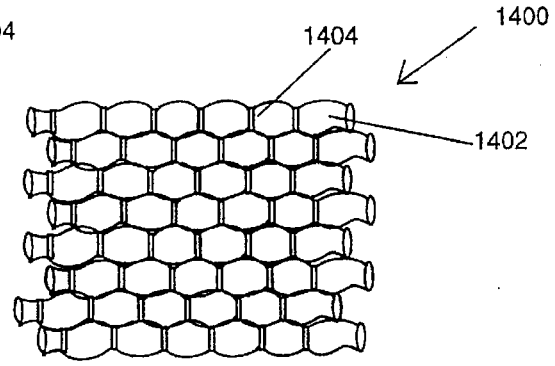
FIG. 21

POLYSURFACIAL MOP HEAD, AND MOP ARTICLE COMPRISING SAME

CROSS-REFERENCE TO RELATED APPLICATION

This is a continuation in part of U.S. patent application Ser. No. 07/922,031 filed Jul. 29, 1992 and abandoned Sep. 21, 1994, which was a continuation-in-part of application U.S. Ser. No. 07/793,854, filed Nov. 18, 1991 and issued Jul. 13, 1993 as U.S. Pat. No. 5,227,228, which was a continuation-in-part of application U.S. Ser. No. 07/471,110, filed Jan. 26, 1990 and issued Nov. 19, 1991 as U.S. Pat. No. 5,066,527, which was a continuation-in-part of application U.S. Ser. No. 07/189,484, filed May 2, 1988 and issued May 18, 1990 as U.S. Pat. No. 4,923,738, all of these applications having been filed in the name of Robert D. Newell.

BACKGROUND OF THE INVENTION

1. Field of the Invention

This invention relates to a mop head which is selectively arrangeable on a mop handle support structure, in a selected one of multiple orientations each presenting a distinct mopping surface, and to a mop article comprising such mop head mounted on a handle support structure thereof.

2. Description of the Related Art

In the field of mop head structures and mop articles, a wide variety of physical configuations, arrangements, and components have been employed and proposed in the art.

U.S. Pat. No. 4,717,616 issued Jan. 5, 1988 to A. D. Harmon, et al discloses a mop head construction comprising a plurality of substantially parallel, abutting strands of textile material, such as roving, or cords of twisted strands and yarns. The main deficiency of this product lies in the fact that absorption is being accomplished through the use of capillary action exhibited by very finely divided fibrous structures possessing a low fluid pick-up and retention capacity on a unit volume basis, thereby physically limiting the amount of fluids, e.g., liquids, or mixtures of liquids and particulates, that can be absorbed per unit volume. Further, due to its large surface area per unit volume, the renewability and driability of this type of fabric is poor. The fluid that is taken up by such mop head is not readily released, so that the sorptive capacity which initially is taken up is unavailable, until the fibrous structure dries by evaporation of the retained fluid.

U.S. Pat. No. 4,313,774 issued Feb. 2, 1982 to J. P. Arthur describes a mop head made of non-woven fabric of a cellulose and synthetic fiber blend which is made by combining plural non-woven continuous fabric sheets in a composite superimposed stack, ultrasonically sealing the stack in a continuous transverse direction of the sheet in the center portion thereof, and the cutting the stack between the ends of the sheets and the central portion to form a plurality of strips.

U.S. Pat. No. 4,114,224 issued Feb. 2, 1988 to E. Disko discloses a mop comprising plural absorptive elements comprising superposed flat layers of bonded non-woven fabric comprising a fibrous web and a binder. The fibrous web comprises at least about 50% by weight of hydrophilic fibers and the binder is present in about 25% to 100% of the fibers, at about 50–400 grams per square meter. The non-woven fabric layers are joined along a medial spine, from which the layers are slit to the extremities thereof to form parallel flat strips ranging in width from about 15–40 millimeters and in length from about 20–60 centimeters.

U.S. Pat. No. 3,520,017 issued Jul. 17, 1970 to T. V. Moss describes a mop swab including a multiplicity of absorbent mop cords which are secured together adjacent the ends of the swab by strands of thread or yarn which extend transversely to the swab in and among the mop cords. The mop cords may also be secured substantially centrally of the swab in a bunched-together relationship, by a canvas or fabric band.

It is well known that many fibrous or fabric substances absorb liquids to some extent. Such substances as cotton fiber and natural cellulose products absorb liquid more efficiently than many man-made fibers, e.g., melt-blown fibers, which cannot absorb water at all, but rather must rely on their capillary reaction to liquids. Thus, such synthetic fibrous yarns must be sufficiently porous to permit the moisture to diffuse between the fibers and be held between the fibers in a cleaning manner. These synthetic fibers, however, are often preferred for many other uses because of their strength, their high wearability and their limited shrinkage.

Desirable characteristics of fibrous webs or fibrous structures in enhancing fluid absorption include: high durability and resistance to abrasion; high absorption characteritics such as those shown by soft, loosely twisted yarns; ready dryability; fast drying; easy wringability; high wet tensile strength; and the ability to withstand repeated laundering without shrinking significantly.

In respect of particulate solids pick-up, retention, and release, a variety of fibrous or fabric-based materials are employed. Fibrous webs or fibrous structures used for such purpose should have the ability to achieve rapid pick-up of solids and release thereof upon shaking or liquid (water) immersion, and should also be resistant to charge effects such as may result in minimal particulate solids pick-up and/or retention efficiency.

U.S. Pat. No. 4,995,133, issued Feb. 26, 1991, to Newell, discloses a mop head comprising a plurality of web elements having involutions therein. The involutions may be formed by treatment conditions comprising successive tensioning/detensioning, compression, differential stressing or stretching, twisting, or a combination of these or other conditions or treatments imparting involutions to the web elements. In one aspect, the web elements are formed of a non-woven material comprising a cellulose and synthetic fiber blend. The mop head utilizes the discovery that interstitially capacitive regions may be employed to contain liquid and/or fluids or mixtures of fluids and particulates within a three-dimensional framework, e.g., fabric structure, which is capable of retaining the fluids by surface tension forces and capacitance of the structure of the fabric. These capacitive interstitial regions of the sorptive structures of the invention of U.S. Pat. No. 4,995,133 also are desirable in that they release fluids and/or solid particulates more easily than conventional absorptive materials due mainly to the small structural surface area required to contain a droplet of liquid or fluid and/or solid particulate in such fabric or sorptive structure.

It would be a significant advance in the art of mop head structures to provide a mop head having a significantly enhanced surface area capacity for particulates and/or liquids, encompassing both dry mopping and wet mopping utility, relative to mop head structures of the prior art.

It is therefore an object of the present invention to provide such an improved mop head structure having utility for diverse dry mopping and/or wet mopping applications, and providing easy fluid and/or particular solid take-up, retention, and release.

SUMMARY OF THE INVENTION

In a broad aspect, the present invention relates to a polysurfacial mop head suitable for use with a mop handle including a generally planar mounting assembly at an extremity thereof for mounting of the mop head thereon, comprising:

a generally parallelly aligned array of elongate strand elements transversely secured by multiple securement members to form a unitary mop head body of generally flat character when reposed on a planar supporting surface, with the securement members constructed and arranged to retain the unitary mop head body in position forming an interior volume bounded by top and bottom panels of the mop head body wherein each panel defines multiple surface portions and comprises a transverse partial width portion of the strand element array, with the securement members constructed and arranged to allow (i) insertion of the mop handle mounting assembly into the interior volume of the mop head body and (ii) securement therein by means of at least one of the securement members, with each of the mop head body panels presenting active mopping surfaces and wherein the mop head body is securable on the planar mounting assembly of the mop handle in at least two differing deployment orientations with the active mopping surface presented to said planar supporting surface comprising differing panel surface portions in the different deployment orientations of the mop head body.

In a preferred aspect of the invention broadly described above, the securement members may suitably comprise web strip elements which are generally perpendicularly oriented in relation to the longitudinal direction of the elongate strand elements of the mop head array. Such strand elements are advantageously secured to the web strip elements, with the web strip elements in longitudinally spaced-apart relationship to one another. The strand elements may be sewn to the web strip elements.

The aforementioned web strip elements may be constructed to extend transversely outwardly from the mop head body to define free ends interconnectible with one another to form the unitary mop head body. Such web strip element opposite free ends may be interconnectible by tying thereof together. Alternatively, the web strip element opposite free ends may be interconnectible by means of respective matable mechanical fasteners at the opposite free ends, by means of respective hook and loop contact fasteners at said opposite free ends, or the web strip element opposite free ends may be interconnectible with one another such that when the opposite free ends of the web strip elements are interconnected, opposite transverse outer margins of the elongate strand element array are in transverse proximity with one another such that the proximate transverse outer margins corporately form a panel of the unitary mop body, and a remaining transverse medial portion of the elongate strand element array forms another panel of the unitary mop body.

In a specific embodiment, the unitary mop body top and bottom panels are interconnected by web strip elements comprising a first web strip element at a first end of the elongate strand element array and sewn along the full length thereof to the elongate strand elements of the top and bottom panels. The first web strip element may circumscribe the unitary mop body, in contact with external top and bottom surfaces of the respective top and bottom panels.

The first web strip element may be sewn such that the top and bottom panels are sewn together to define a closed end of the interior volume of the unitary mop head body. A second web strip element may be provided at a second end of the elongate strand element array and sewn along the full length thereof to the elongate strand elements of the top and bottom panels. Such second web strip element may circumscribe the unitary mop head body, in contact with the external top and bottom surfaces of the respective top and bottom panels.

The second web strip element may be provided at a second end of the elongate strand element array and sewn along the full length thereof to the elongate strand elements of the top and bottom panels, with the second web strip element being sewn such that the top and bottom panels are sewn together to define a closed second end of the interior volume of the unitary mop head body, whereby the generally planar mounting assembly of the mop handle may be inserted between elongate strand elements of the unitary mop head body into the interior volume of the unitary mop head body.

The mop head may be constructed wherein the mop handle comprises a generally planar platform assembly and an elongate shaft member selectively joinable at one end to the generally planar platform assembly and manually grippable at an opposite end for use of the mop formed by coupling the mop head with the mop handle, with the mop head further comprising a second web strip element at a second end of the elongate strand element array and sewn along the full length thereof to the elongate strand elements of the top and bottom panels, but with the top and bottom panels being separable at said second end of the elongate strand array to allow ingress by the generally planar mounting assembly of the mop handle into the interior volume of the unitary mop head body, and with at least one intermediate web strip element positioned circumscribingly about the unitary mop head body between the first and second ends thereof and sewn along the full length thereof to the elongate strand elements of the top and bottom panels, but with the top and bottom panels being separable between the first and second ends to allow longitudinal passage of the generally planar platform assembly in the interior volume subsequent to ingress of the generally planar platform assembly into the interior volume such that the generally planar platform element is wholly reposable in the interior volume, with the elongate shaft member of the mop handle being insertable between elongate strand elements and coupleable to the generally planar platform assembly.

As an alternative to the web strip element securement members mentioned above, the strand element securement members may otherwise comprise sewn stitchings, or bondant medium deposits, interbonding elongate strand elements to one another.

In the mop head of the present invention, the elongate strand elements may be treated with a treatment agent selected from the group consisting of antistatic agents, particulate pick-up enhancement materials, fluid pick-up enhancement materials, and mixtures thereof.

In another aspect, the present invention relates to a mop article comprising:

a mop handle including an elongate shaft member with first and second ends, being manually grippable at the first end thereof, and a generally planar mounting assembly constructed and arranged for mounting of a mop head thereon, and selectively joinable to the elongate shaft member at the second end thereof; and a generally parallelly aligned array of elongate strand elements transversely secured by multiple securement members to form a unitary mop head body of generally flat character when reposed on a planar supporting surface, with the securement members constructed and arranged to retain the unitary mop head body in position forming an interior volume bounded by top and bottom panels of the mop head body wherein each panel defines multiple surface portions and comprises a transverse partial width portion of the strand element array, with the securement members constructed and arranged to allow (i) insertion of the mop handle mounting assembly into the interior volume of the mop head body and (ii) securement therein by means of at least one of the securement members, with each of the mop head body panels presenting active mopping surfaces and wherein the mop head body is securable on the planar mounting assembly of the mop handle in at least two differing deployment orientations with the active mopping surface presented to said planar supporting surface comprising differing panel surface portions in the different deployment orientations of the mop head body.

In another aspect, the present invention relates to a mop head assembly comprising an extended support structure which is "breakable" at a medial part thereof, so that the outer extremeties of the structure pivotally detension to a relaxed condition, in which the mop head body secured to the support structure may be readily wrung out, or otherwise prepared for reuse (e.g., in dry mopping or applicator uses).

A further aspect of the invention relates to a mop head comprising:

a mop head support assembly comprising structural segments which are selectively reposable in either one of (i) an extended conformation, and (ii) a detensioned conformation;

selectively actuatable means for selectively locking the structural segments in said extended conformation, and for selectively detensioning the structural segments from the extended conformation and placing the structural segments in the detensioned conformation;

a mop head main body portion comprising an array of elongate strand elements secured together in a unitary structure;

means for securing the mop head main body portion to said segments, so that the mop head main body portion is extended with the array of elongate strand elments defining a mopping surface when said segments are in said extended conformation, and so that the mop head main body portion is detensioned when said segments are in said detensioned conformation.

The elongate strand elements in such mop head may for example comprise a wood pulp/polymer fiber blend. In a specific embodiment of the mop head described in the preceding paragraph including the appertaining component element subparagraphs, the mop head main body portion may advantageously comprise two main faces each bearing a said array of elongate strand elements, so that the mop head main body portion is selectively repositionable to present a selected one of said two main faces as said mopping surface.

BRIEF DESCRIPTION OF THE DRAWINGS

FIG. 18 is a partial perspective view of a mop article comprising a woven looped material in the mop head body panels.

FIG. 19 is a partial perspective view of a mop article according to yet another embodiment of the invention.

FIG. 20 is a perspective view of a knitted material which may be employed as a material of construction for panels of a mop head body according to another embodiment of the invention.

FIG. 21 is a top plan view of a braided strand array from which panels of a mop head body according to a further embodiment of the invention may be constructed.

BRIEF DESCRIPTION OF THE PRESENT INVENTION, AND PREFERRED EMBODIMENTS THEREOF

Figure 1:
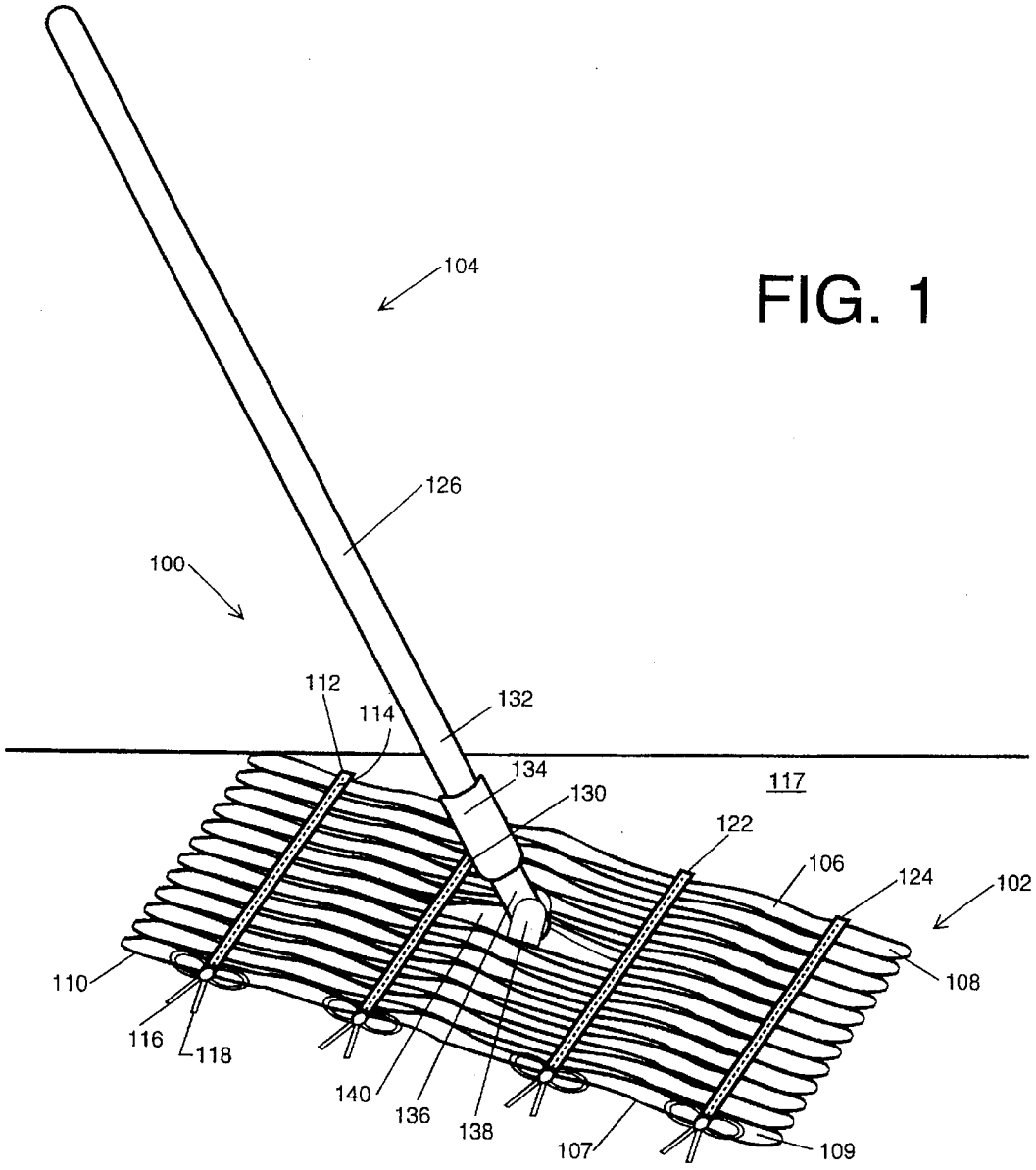
FIG. 1 is a perspective view of a mop article according to one embodiment of the present invention, featuring a polysurfacial mop head structure.

The present invention is based on the discovery that an array of elongate strand elements, formed of suitable web, fibrous, polymeric, etc. materials, may be constructed to provide a polysurfacial mop head structure, having plural potentially active mopping surfaces, whereby after a first active mopping surface has been exhausted or otherwise used for a selected time and/or to a selected extent, another active mopping surface can be provided by reorientation or repositioning of the mop head on a mop handle platform assembly of conventional type, such as is joined or joinable to an elongate shaft member manually grippable at its opposite end for use of the resulting mop article.

The mop head structure of the present invention comprises an array of generally parallelly aligned elongate strand elements, which may for example constitute an assemblage of fibrous web sorptive elements having capacitive (e.g., interstitial) spaces capable of holding fluids (e.g., liquids) and/or particulate solids (including semi-solids, gelatinous materials, and other flowable or partially flowable or self-leveling materials), and a structural arrangement, of retaining or consolidating means imparting a unitary or consolidated character to the assemblage of fibrous web sorptive elements, whereby the aggregate article may be used for absorbing various fluids, liquids, and/or particulate substances. Suitable retaining or consolidating structure may comprise, inter alia, convolutions or conformations of the fibrous web elements themselves, whereby the fibrous web elements may be aggregated in a matted, bunched, tufted, or intertwined manner to provide a unitary or otherwise consolidated assemblage of the fibrous web elements.

The term "fibrous web" as used herein means a nonwoven or woven fabric wherein non-woven fabrics, the individual fibers, rather than yarns, are the basic elements of the structure. Both fabric types may be used in the invention, but nonwoven fabrics are preferred because of their increased absorptive capacity (per volume of weight with less density), particularly when treated as described in U.S. Pat. No. 4,955,133, and because of their generally lower costs than those associated with woven fabrics. The fibrous web materials may be porous or non-porous.

Nonwoven fabrics consist essentially of fibers, web and binder. The fibers are typically of rayon, nylon, polyester, polypropylene, cotton, wood pulp, olefin, fiberglass or any other long (filament) or short (staple) fibers. The web may be carded, wet, dry, or air formed, air dispersed, melt blow, or spunbonded. The binders known in the art include latex, low-melt fibers, powders, thermally responsive substances, composites, and needle-punched substances, as well as other chemical, polymer and stitchbond binders.

The types of nonwoven bonding systems include adhesive systems such as melt blown processes where tacky, melted, extruded polymer fibers come in contact with other fibers and stick together; use of chemicals, such as acrylates, in chemical systems such as saturation, and foam or spray bonding; methods using air-pressure and heat, typically used with melted adhesion fibers; needle-punching, where fibers are physically entangled; solvent treatment to make fibers sticky; sonic energy treatment to heat or melt fibers; and water entanglement ("spunlace") where the force of water and/or air streams is used to entangle the fibers.

Fibrous web materials that may be used include those made of natural fibers, synthetic fibers, and combinations thereof. Thus, natural nonwovens of cotton linters and cotton staple; dissolving pulp; flax, jute or ramie pulp; papermaking pulp or wool; as well as synthetic nonwovens of acetate filament or staple; acrylic filament or staple; aramids, carbon; glass filament or staple; inorganic ceramic; modacrylic filament or staple; nylon filament or staple; polyacetal; polybenzimidazole; polyester filament or staple; polyphenylene sufide; polypropylene filament or staple; polyvinyl alcohol; rayon filament or staple; spandex and other elastomers; specialty olefins; polyethylene; and vinyl filament and staple, are included within the nonwovens that may be used in the strand elements of the invention.

A preferred fibrous web material which may be usefully employed to form strand elements comprises spun-laced nonwoven fabrics. Spun-laced fabrics may be made of precursor webs comprised of 100% polyester or rayon, polyester blends, such as with rayon or wood pulp or other synthetic or natural fibers such as acrylics or olefin or cellulosic fiber. Spun-laced fabrics comprise mechanically interlocked fibers and fiber bundles where the energy causing the fiber interlocking comes from small diameter, high pressure water streams which impinge on a web formed by carding, air laying or wet laying the fibers on a screen or forming wire. Preferred components of the web materials used in the invention are hydroentangled synthetics such as form 30% to 100%, e.g. 45%, wood pulp or rayon, and from 0% to 70%, e.g., 55%, polyester; cotton-polyester; or cellulosic-polyester.

Other nonwoven materials that may be used include air laid nonwovens, carded and random fiber nonwovens, melt-blown nonwovens, needle-punched nonwovens, scrim nonwovens, spunbonded nonwovens, stitchbonded nonwovens, tow nonwovens and wet laid nonwovens.

Another type of nonwoven material that may be used as the fibrous web material of the strand elements comprises pieces or strips as used to make "highloft" products such as felting, padding, and thermal insulating strips, which are typically made of various cellulose and/or synthetic pulps.

In place of, or mixed with, the fibrous web nonwoven material, foam materials having internal interstitial spaces may be used. Foams of cellulosic, polyolefin, polystyrene, polyurethane, and combinations thereof may be used in combination with nonwoven materials.

The fibrous web material used to form the elongate strand elements may be in the form of whole or partial sheets, strips or web, or chopped or shredded web pieces. Thus, in its broadest aspect, any scrap pieces of fibrous web material may be used in the present invention. Preferably, the web material is in strips 2–10 inches wide. However, any pieces of a thickness and conformation capable of forming interstitial or capacitive spaces to take up fluid may be used. It is to be understood that the choice of size and shape of the fibrous web strand elements must allow for the retaining or aggregating means or structure to maintain the physical integrity of the mop head structure.

In the preferred practice of the invention, the fibrous web elements comprise a plurality of stands of web material, each of which preferably extends the entire length of the sorptive article. The strands are generally parallel to each other, but may be twisted, matted, snaked, or otherwise aggregated with or about one another.

Prior to consolidation by the securement means, each strand may suitably be treated by unidirectional stretching or twisting followed by cessation of such stretching or twisting, resulting in a continuous, laterally involuted or twisted ribbon creating structurally stable intestitially capacitive spaces, as disclosed by commonly owned U.S. Pat. No. 4,995,113, the disclosure of which is incorporated herein by reference. In this respect, it is to be appreciated that any other sorptive elements employed in the mop head structures of said U.S. Pat. No. 4,995,133 may potentially usefully be employed in mop heads in accordance with the present invention. The unidirectional stretching usefully employed to produce fibrous web elements with capacitive regions is preferably applied by imparting collaterally imbalanced stresses to a fibrous web so that not all portions of the web are stretched or twisted to the same extent. Such differential stretching results in formation of involutions in the web piece, so that the edges of the web roll inward, twist or gather, producing a fibrous web element of capacitance character. Surface winding machines may be used to differentially longitudinally stress the web to form involutions. When the resulting, e.g., laterally involuted, structure is placed in proximity to a fluid such as water, organic solvents, oil, etc., its shape provides regions into which the fluid flows by capillarity and surface tension effects. In addition, such capacitive structures have capacity for the take-up, retention, and disengagement of particulate solids, e.g., dust particles, sub-micron aerosolized solids, grit particulates produced by machining operations, etc.

Other types of stresses, as disclosed in U.S. Pat. No 4,995,133, such as heating, use of peening apparatus, and use of differentially hydrophilic laminae may be used to impart collaterally imbalance stresses to the web pieces or elements.

A plurality of such capacitive fibrous web strand elements may be placed in a side-by-side or bundle configuration and held together by a suitable securement means.

The securement means must bind or otherwise aggregate the strand elements so as to produce a unitary strand array and maintain its shape. This may be done using retaining means such as: open mesh sleeves, bands, or other mesh retaining means; bindings comprising wire, string, filament, cord, etc.; adhesive systems; melt bonding; retaining means such as staples or clips; spot-bonding with glue or other adhesive media; physical tying together of fibrous web elements; interpenetration of such elements; or any other suitable consolidation or aggregating means, methods and/or techniques.

The strand elements of the invention may be made in any length, width, thickness, shape, configuration, conformation, or in any size or form rendering it useful for mopping purposes. The specific geometric and structural characteristics of the strand elements will depend on the specific material of construction and conformation of the strand element. The strand elements for example may comprise generally flat, involuted strips of 1–3 inches in width, or alternatively such flat strips may be twisted or wound to a more compact structural configuration. The strand elements alternatively may comprise braided or helically wrapped cords, ropes, or the like. Regardless of the specific form of the strand elements, it generally is desired that they are characterized by high surface area for take-up, retention, and selective release of particulates and/or fluids, depending on the mopping application to which the mop head of the invention is directed. Thus, the mop head of the present invention may be employed for dry mopping and/or wet mopping, depending on the specific end use application involved. The strand elements are preferably elongate in character, i.e., having a length or longitudinal extent which is at least twice the width or lateral extent of the strand element.

In order to enhance the mopping ability of the mop head comprising the strand elements, the strand elements may be impregnated or otherwise treated, e.g., by surface application treatment, with any suitable formulations, compositions, or substances. Examples include materials to enhance the dust or other particulate engaging and retention ability of the strand elements, such as lipophilic dust-attracting substances, such as wax or oil-based materials. Alternatively, or in addition, the strand elements may be treated with hydrophilic, hydrophobic, lipophilic, lipophobic, or other substances to enhance the fluid take-up and retention ability of the mop head comprising such strand elements. In the application is one in which static electricity generation is problematic, the mop head strand elements may be treated with a suitable anti-static agent, to minimize the risk and occurrence of static charge build up in the mop during its use.

Particularly preferred materials of construction for the strand elements in the practice of the present invention include cotton, olefin, and polymeric fibers, polyesters, polypropylene, rayon, acrylics, rayon/polyester blends, cellulosic materials, such as wood pulp, wood pulp/polyester blends, etc. A particularly suitable material for fabricating such strand elements is a cellulose and synthetic resin fiber blend, including the materials which are commerically available under the trademark SONTARA® from E.I. Dupont de Nemours and Company (Wilmington, Del.), including polyester, polyester/rayon blends, wood pulp/polyester blends, and aramid materials. Of these materials, which are spun-laced fabrics, a material comprising a 55%/45% by weight wood pulp/polyester blend, available as SONTARA® 8801 and 8818 are particularly preferred, since this material has a high sorptive capacity in wet mopping applications, as well as good dry mopping properties for dust mopping and the like. In general, the non-woven materials which may be usefully employed in strand elements according to the present invention include any suitable configuration or structural type of non-woven materials, including melt-blown, spun-laced, spun-woven, spun-bonded, hydroentangled, etc., materials.

Other non-woven materials which may be usefully employed in strand elements in mop head structures of the present invention include the non-woven materials available under the following trade names: "Omega", "Webril", "Alpha", "Curity", "Kendall", and "Webcol" (Veratech [International Paper/Kendall]); "Assure", "Hydrospun", and "Dextex" (Dexter); "Like-rag", "Reddrags", and "Busboy" (IFC); "Key Bak", "Solventwipe", "Chix-Plus", and "Duralace" (Chicopee); "Ultra Wipe" and "Sure Wipe" (Fort Howard); "Handiwipes" (Colgate/Palmolive); "Kintex" (Kimberly-Clark); "Scott Cloth" (Scott Paper); "Nexus" and "Softspun" (Precision Fabrics Group, Inc.); and "Vilmed" (Freudenberg).

In order to enhance fluid take-up and retention capacity in wet mopping applications, the mop head of the present invention may comprise strand elements having associated therewith any of a variety of sorption enhancing materials or additives. For example, in a single-use mop application, the strand elements may be impregnated or otherwise have associated therewith a super-absorbent material. Such super-absorbents, or hydrogels, may be of any suitable type, and are readily commercially available from a variety of sources, including the products available under the following trade names: "Favor" super-absorbent powder (Stockhausen, Greensboro, N.C.); "Sanwet" super-absorbent polymer (Chemdal); "Aquasorb" sorbent (Aqualon, Wilmington, Del.) "SuperSorb" (Super Absorbent Company, Lumberton, N.C.); and "DryTech" super-absobent (Dow Chemical Company, Midland, Mich.).

In order to enhance the particulate take-up and retention capacity in dry mopping applications, the mop head of the present invention may be treated with a suitable particulate-retention enhancing substance, such as a lipophilic or oil-based material. Examples include parafinnic oils, mineral oils, waxes, etc. In general, any substance or composition which is effective to enhance the particulate take-up and/or retention capacity of the mop head, and which is otherwise compatible with the mop head materials of construction and materials to be encountered in the mopping application, may be suitably employed. Hydrophilic as well as hydrophobic materials of such type may be employed, to the extent that same are effective to enhance the dry mopping capability of the mop head. Examples of dry mopping enhancement agents which may be potentially usefully employed on mop heads according to the present invention include formaldehyde resins, linseed oil, emulsified wax formulations, static cling treatment substances, anti-bacterial coatings of various types, and chemicals and formulations providing such a dry mopping enhancement function when impregnated or otherwise applied to the web elements of the mop head.

A potentially usefully employed treatment for enhancing of the particulate take-up, retention, and release capacity of the strand elements of the mop head is a mop treatment composition commercially available as DUSTROI BACTERIOSTATIC mop treatment, available from GOLDEN STAR INC. (North Kansas City, Mo.). Other mop treatment agents which may be usefully employed for such purpose in the broad practice of the invention include those available under the following trade names: "Sanco Treat" (Sanitary Products Corp.); "Aqua Mist" (I. Schneld, Inc.); "Aqua Sheen" (James Varley & Sons, Inc.); "Aqua-Treat" (Perma, Inc.); "Clean-Sheen" (Magee Industrial Division); "Cen-Dust" (Cental Chemical Company); "D-Dust" (Oil Specialties & Refinery Co., Inc.); "Duff" (Hysan Corp.); "Dy-Dust" (The Davis-Young Company); "Dust-Loc" (Tu-Way Products Co.); "Dust-n-Shine" (Wilen Manufacturing); "Floor Shee" (James Varley & Sons, Inc.); "Guardian" (ABCO, Inc.); and "Noil" (Betco Corp.).

With respect to bacterial properties of strand elements which may be employed in accordance with the present invention, it is to be appreciated that the materials of construction of the strand elements may be selected so as to provide an intrinsic bacterial barrier. For example, wood pulp in the form of tissue can be coentangled with polyester to form a wood pulp rich composite fabric that is very effective as a bacterial barrier.

It will be further appreciated that mop heads according to the present invention may be treated with or comprise any other suitable materials, additives, treatment agents, and the like, which do not preclude the efficacy of the mop head for its intended purpose. Examples of such additional materials include flame retardants, surfactants, antioxidants, binders, reinforcing agents, pigments, etc.

Referring now to the drawings, FIG. 1 shows a perspective view of a mop article according to one embodiment of the present invention, featuring a polysurfacial mop head structure.

The mop article 100 comprises a mop head 102 which is selectively joinable to the mop handle 104 by means of the generally planar mounting platform 140 having upwardly extending flange elements 138 mounted thereon for coupling with the lower section 136 of the handle 104, lower section 136 being joined by means of collar 134 to joining section 132 of elongate shaft member 126. At its upper end, elongate shaft member 126 is manually grippable to direct the mop head in a selected direction and manner, as is conventional practice. The mounting platform 140 of the mop handle is generally planar and may suitably comprise a thin metal plate, planar wire loop, or alternatively any other generally flat configuration which is accommodated within the interior volume of the mop head 102 between the upper panel 106 and lower panel 107 portions thereof.

The mop head 102 comprises a generally parallely aligned array of the elongate strand elements 108 transversely secured by multiple securement members 112, 130, 122, and 124 to form a unitary mop head body of generally flat character when reposed on a planar supporting surface 117.

The securement members 112, 130, 122 and 124 are constructed and arranged to retain the unitary mop head body in position forming an interior volume bounded by top panel 106 and bottom panel 107 of the mop head body. Each panel defines multiple surface portions and comprises a transverse partial width portion of the strand element array—in the embodiment shown in FIG. 1, top panel 106 defines a top exterior surface portion and a bottom interior surface portion, while the bottom panel defines a bottom exterior surface portion and a top interior surface. Each of such panels is a half-section of the mop head body, which is folded at one edge (opposite the tied bows formed by tying free ends 116 and 118, as shown in FIG. 1 and described more fully hereinafter).

The elongate strand elements thus extend from a first end 109 to an opposite end 110 which may be of significant length, e.g., 2, 4, or even 6 feet, the width or transverse dimension being corresponding proportioned to the length, as desired or otherwise suitable for the given end use application.

The securement members 112, 130, 122, and 124 shown in FIG. 1 comprise web strip elements which are each stitched by seam stitching 114 to the associated strand elements of the respective panel sections of the mop head body. Thus, the web strip elements circumscribe the mop head body, terminating in the free ends 116 and 118 which may be tied, knotted, or otherwise interconnected to retain the unitary mop head body in position forming an interior volume between the respective top and bottom panels of the mop head.

In other words, the web strip element comprising the securement means on the top panel is sewn to the strand elements forming the top panel, and on the bottom panel (not shown in FIG. 1) the web strip elements forming the securement means are sewn to the strand elements forming the bottom panel of the unitary mop head body. The mop head body has a generally flat character when reposed on the planar supporting surface 117, as shown.

The mop head body shown in FIG. 1 may be re-configured to provide different active mopping surface from that formed by the bottom exterior surface of the bottom panel of the mop head body. For example, the mounting platform 140 of the mop handle may be uncoupled from the elongate shaft member 126 and the generally planar mounting assembly 140 may then be inverted within the interior volume of the mop head body, so that the flange elements 138 protrude from a medial part of the bottom panel, so that when the mop head is turned over relative to the position shown in FIG. 1, so that the top panel 106 in FIG. 1 becomes the bottom panel in the new configuration, the elongate shaft member 126 of the handle may be coupled to the flange elements 138, so the formerly top exterior surface of the top panel becomes the active mopping surface as such formerly top panel becomes the bottom panel in the new configuration.

Further, it is possible to obtain additional active mopping surface from the mop head body shown in FIG. 1, by the expedient of untying or otherwise disengaging the interconnected free ends 116 and 118 of the mop head, followed by eversion of the respective panels of the mop head, so that the top and bottom exterior surfaces of the mop head shown in FIG. 1 are brought into facing relationship in the interior of the everted mop head, with the free ends 116 and 118 of the securement means again being interconnected in the everted configuration, so that two new active mopping surfaces are provided from the surface portions formerly constituting the interior facing surfaces of the panels in the interior volume of the mop head body.

By such expedient, four separate and distinct active mopping surface portions are provided in the mop head structure of FIG. 1.

Figure 2:
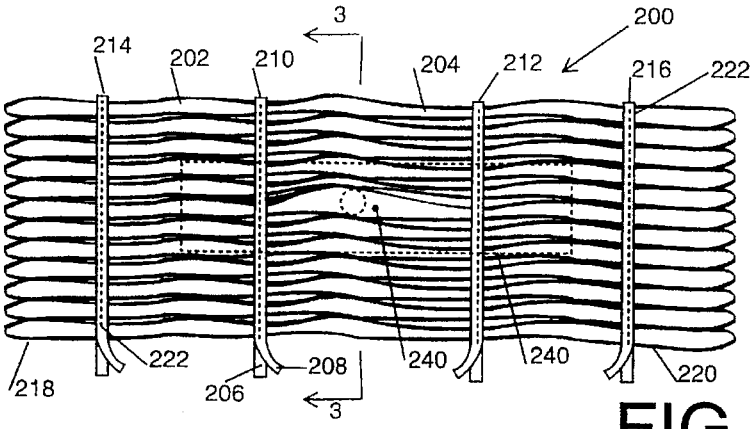
FIG. 2 is a top plan view of a mop head according to another embodiment of the present invention.

FIG. 2 is a top plan view of a mop head 200 according to another embodiment of the present invention.

As shown, the mop head 200 comprises a unitary array 202 of elongate strand elements 204 which are generally parallely aligned with one another to form the unitary body. The mop head in this embodiment is constructed similarly to FIG. 1, comprising top and bottom panels which are superposingly positionable with respect to one another, so that the free ends 206 and 208 of the web strip elements 210, 212, 214, and 216 are tiable or otherwise interconnectable in the same manner as the analogous web strip elements in the embodiment of FIG. 1.

In the embodiment of FIG. 2, the web strip elements 210, 212, 214, and 216 associated with the strand element array are sewn by seam stitchings 222 to the respective top and bottom panels of the mop head 200. As a result, the securement means constituted by web strip elements 210, 212, 214 and 216, and seam stitchings 222, thereby establish a unitary array of longitudinally extending (elongate) strand elements which is folded longitudinally (parallel to the longitudinal axis L—L as shown in FIG. 2) to define an interior volume 230 as shown in the cross-sectional elevation view of FIG. 3, taken along line 3—3 of FIG. 2. Such interior volume thus is defined and bounded by the panels or sections of the mop head on either side of the longitudinal fold line F—F (see FIGS. 3 and 4). Each of such panels is of a corresponding comparable (substantially equivalent) width, wherein the width is measured along the width axis W—W (see FIG. 3) transverse to the longitudinal axis L—L (see FIG. 2) of the mop head array of strand elements.

Figure 3:
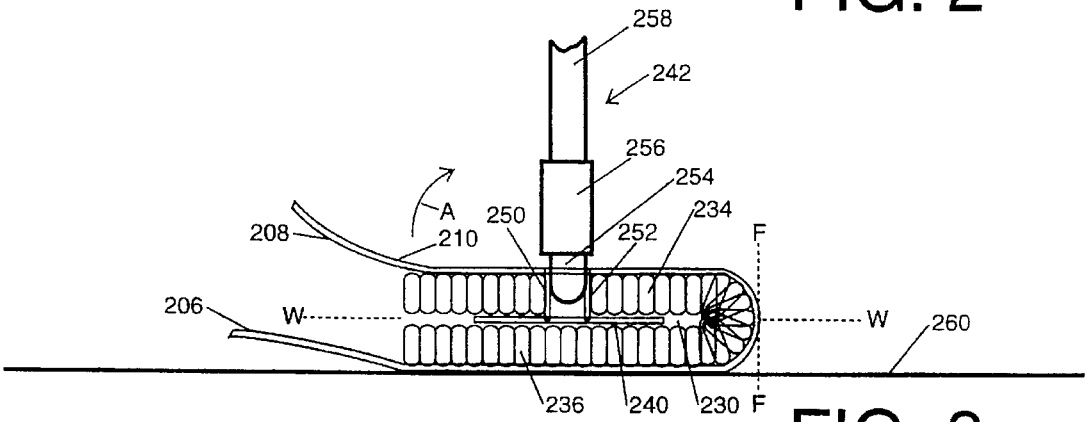
FIG. 3 is a side elevation view of the mop head of FIG. 2, taken along line 3—3 thereof.

Thus, as shown in FIG. 3, the strand element array 202 is continuous between its top panel 234 and bottom panel 236, being folded at fold line F—F, such that the top panel 234 and bottom panel 236 are superposed, to define the aforementioned interior volume 230. In the interior volume 230 is disposed the generally planar mounting assembly 240 of the mop handle 242. The generally planar mounting assembly 240 comprises a flat platform element in the embodiment shown, which is joined by a means of flange elements 250 and 252 to the lower joining portion 254 of the mop handle, which in turn is connected by collar 256 to the elongate shaft member 258.

FIG. 3 shows the respective free ends 206 and 208 which extend respectively from the bottom and top panels of the mop head, being opposite ends of the continuous web strip element 210. In this fashion, the free ends 206 and 208 of the web strip elements are matably engageable with one another, e.g., being provided with Velcro hook and loop fasteners on their engageable surfaces, or alternatively tieable or otherwise interconnectable, so that the mounting plate or platform element 240 of the mop handle is securely retained within the interior volume of the mop head. To evert the mop head panels and provide additional active mopping surfaces, the free end 208 of top panel 234 may be translated in the direction indicated by arrow A in FIG. 3 after removal of the mop handle 242 and platform mounting element 240 thereof from the mop head. Such removal may be effected by uncoupling the lower joining section 254 of the mop handle from the flanges 250 and 252 connected to plate 240, followed by transverse (lateral) removal of the plate 240 from interior volume 230 and axial translation of the mop handle elongate shaft member 258, whereby the handle is removed in its entirety from the mop head.

Figure 4:
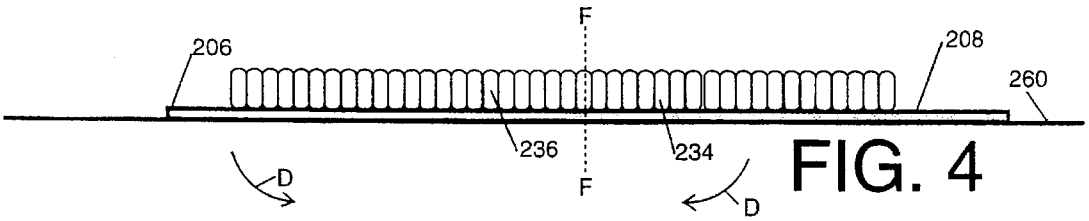
FIG. 4 is an elevation view of the mop head of FIGS. 2–3, in opened conformation in relation to the folded conformation of FIG. 3, for the purpose of reforming the mop head with new active moping surfaces.

With such removal of the mop handle, the translation of the mop head upper panel in the direction A shown in FIG. 3 is continued until the top panel 234 is reposed as shown on the planar supporting surface 260, whereby the top panel 234 becomes coplanar with the bottom panel 236, the fold line F—F being also shown in FIG. 4 for reference.

Figure 5:
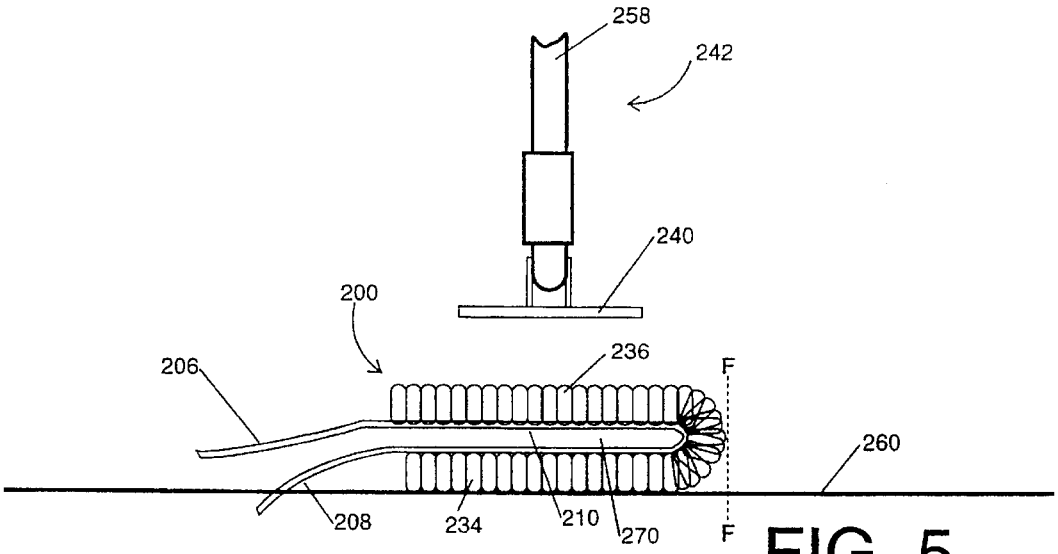
FIG. 5 is a view in elevation of the mop head of FIGS. 2–4, as reconfigured, and with an associated mop handle, wherein the mop head shown in FIGS. 2 and 3 has been unfolded as shown in FIG. 4 and then oppositely refolded to provide new active moping surfaces.

If the mop head then is picked up from the planar supporting surface 260 and the respective panels 234 and 236 are oppositely directed to one another by translation thereof in the directions indicated by arrows D of FIG. 4 an everted mop head 200 is formed, as shown in FIG. 5 together with the associated mop handle 242 for reference, fold line F—F being shown for the same purpose.

FIG. 4 is an elevation view of the mop head of FIGS. 2–3, in opened conformation in relation to the folded conformation of FIG. 3, for the purpose of reforming the mop head with new active moping surfaces.

FIG. 5 is a view in elevation of the mop head of FIGS. 2–4, as reconfigured, and with an associated mop handle, wherein the mop head shown in FIGS. 2 and 3 has been unfolded as shown in FIG. 4 and then oppositely refolded to provide new active moping surfaces.

By such eversion, panel 234, which in the prior configuration (FIGS. 2 and 3) was the top panel, now has become the bottom panel. Conversely, the formerly bottom panel 236 has become the top panel 236 in the reconfigured mop head shown in FIG. 5.

The web strip element 210 previously circumscribing the exterior surfaces of the mop head when the free ends were matably engaged with one another, e.g., tied, now is interiorly disposed in the folded strand element panel, such that the respective free ends 206 and 208 of panels 236 and 234 extend outwardly from the interior volume 270 of the reconfigured mop head.

The platform 240 of the mop handle then may be uncoupled from the elongate shaft member 258 and invertedly (relative to the position shown in FIG. 3) repositioned in the interior volume 270 of the mop head, subsequently being recoupled to the shaft member 258, while the free ends 206 and 208 are again matably engaged with one another, so that the resulting mop head is rendered operational in character in the new conformation.

In this manner, four distinct and separate active mopping surfaces are provided in the mop head embodiment of FIGS. 2–5, corresponding to the top external surface bottom external surface, bottom internal surface and top internal surface of the respective panel elements in the configurations shown in FIGS. 3 and 5.

Figure 6:
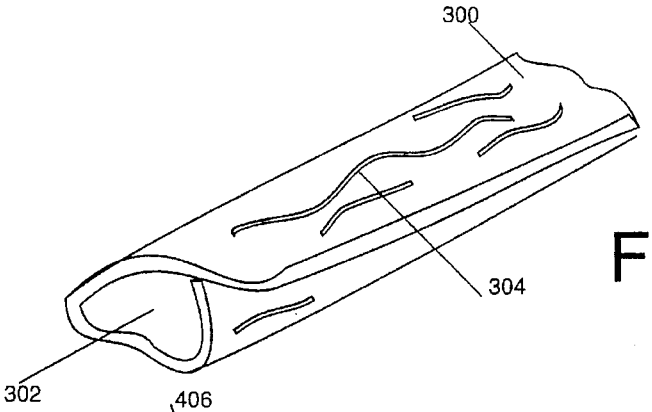
FIG. 6 is a perspective view of an elongate strand element such as may be usefully employed in the mop head structures of the present invention.

FIG. 6 is a perspective view of an elongate strand element 300 such as may be usefully employed in the mop head structures of the present invention. The strand element 300 as shown is formed by a rolled and twisted sheet of fibrous web material, defining the interior cavity 302 and featuring extensive involutions 304 over its entire surface area, thereby providing a highly suitable surface for pick, retention, and selective release of particulates and/or fluids in use of the mop head comprising an array of such elements.

Figure 7:
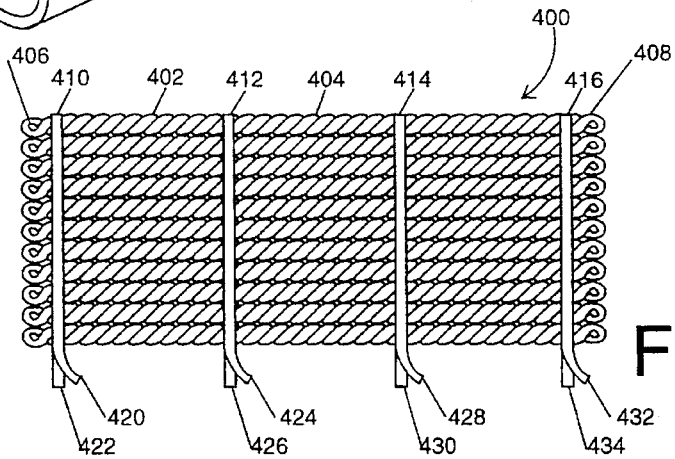
FIG. 7 is a top plan view of a mop head according to still another embodiment of the present invention.

FIG. 7 is a top plan view of a mop head 400 according to another embodiment of the present invention. As shown, the mop head 400 comprises a generally rectangular array 402 of helically twisted strand elements 404 which at their ends 406 and 408 define loop structures. The mop head shown in FIG. 7 is constructed analogously to the mop heads of FIGS. 1–5, in the provision of top and bottom panels (only the top panel being visible in the plan view of FIG. 7).

Exteriorly circumscribing the and bottom panels of mop head 400 are securement means 410, 412, 414, and 416, each of which comprises a web strip element having respective free ends 420, 422, 424, 426, 428, 430, 432, and 434. The first ends 420, 424, 428, and 432 of such web strip elements are provided on their bottom surfaces with a first surface of a loop and hook fastener system, with the bottom surface of the free ends 422, 426, 430, and 434 being provided with a complementary surface of such hook and loop fastener system. In this manner, the fasteners are respectively fastenable to provide a continuous flattened-roll structure having an interior volume therewith for accommodation of a mop handle, in the previously described manner.

The web strip elements 410, 412, 414, and 416 of the mop head may be formed of any suitable materials of construction, as appropriate to the construction and end use of the mop article comprising same. For example, the web strip elements may be constructed of a polypropylene, polyester, or other suitable material of construction, such as the materials illustratively mentioned hereinabove for the elongate strand elements of the mop head. Such web strip elements serving as the securement means for holding the strand elements together in a generally parallel array may suitably be adhesively bonded to the strand elements of the associated panel, whereby the unitary structural character of the mop head body is accommodated.

Figure 8:
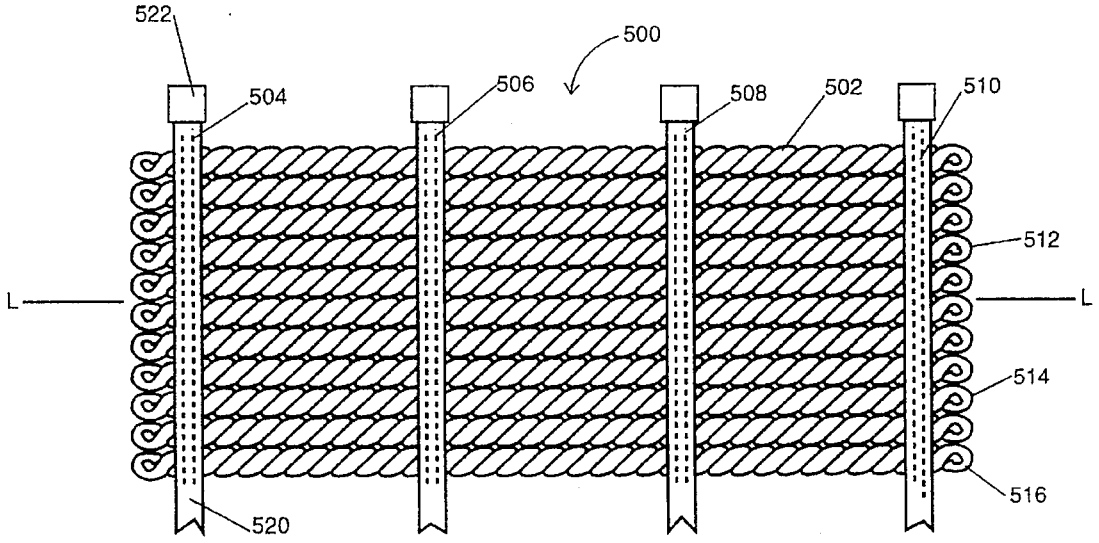
FIG. 8 is a top plan view of a strand element array formable into a mop head structure according to another embodiment of the present invention.

FIG. 8 is a top plan view of a strand element array formable into a mop head structure according to another embodiment of the present invention. The strand element array 500 shown in FIG. 8 is longitudinally foldable along fold line L—L whereby the upper half section (above fold line L—L) in FIG. 8 as shown is superposable on the lower half section (below fold line L—L) of the strand array, to form a unitary mop head body 600 as shown in end elevation view in FIG. 9, coupled with a mop handle 602.

As shown in FIG. 8, the parallel array 500 of strand elements 502 is maintained in unitary form by securement means comprising web strip elements 504, 506, 508, and 510, which may be bonded, mechanically affixed, or otherwise joined to the elongate strand elements 502 of the array 500. The respective panels of the array, comprising upper panel 512 and lower panel 514 as shown in FIG. 8, feature looped ends 516 of the strand elements at both longitudinal extremities of the array. The web strip elements 504, 506, 508, and 510 feature at the respective free ends mechanical fastener means comprising male fastener elements 520 and female fastener elements 522, which interconnect to form the coupled fastener assembly 524 of FIG. 9.

Figure 9:
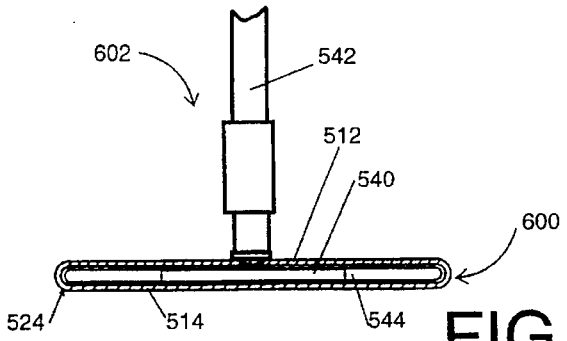
FIG. 9 is an end elevation view of a mop article comprising a mop head formed by folding of the strand array of FIG. 8.

As shown in FIG. 9, the platform element 540 forming the mounting assembly of the mop handle 602 is coupled with elongate shaft member 542 in the previously described manner. The top panel 512 is superposed on bottom panel 514 to define an interior volume 544 in which the platform element 540 is disposed. This construction of the mop head is vertically reversible (so that the bottom surface becomes the top surface, and vice versa) as in preceding embodiments, and as in such preceding embodiments is evertable so that the interior surfaces bounding the interior volume 544 subsequently after eversion become exterior active mopping surfaces which are selectively engagable with a floor or other surface to be mopped in either of two orientations, yielding a total of four active mopping surface configurations for the mop head.

Figure 10:
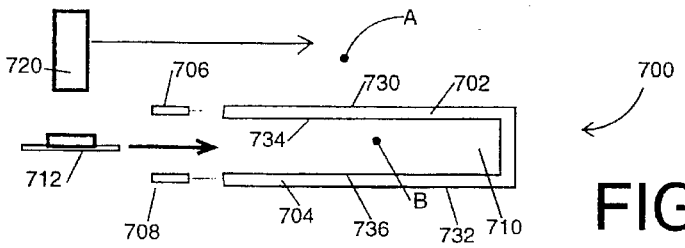
FIG. 10 is a schematic representation of a mop head constructed in accordance with one embodiment of the present invention, with an associated mop handle, illustrating the construction and assembly of the mop head and resulting mop article.

FIG. 10 schematically shows a mop head 700 comprising a top panel 702 and bottom panel 704 arranged as shown with associated securement members 706 and 708 which are interconnectible with one another to form an enclosed interior volume 710 with which the mounting member 712 of the mop handle may be disposed, at locus B, being subsequently connected to elongate shaft member 720 of the mop handle, with the shaft element extending through the top panel of the strand element array at locus A. The mop head schematically shown in FIG. 10 features a top exterior surface 730, a bottom exterior surface 732, a top interior surface 734 and a bottom interior surface 736.

By this arrangement, and the selectively connectable and disconnectable coupling means 706 and 708, the mop head 700 is invertable and evertable, so that each of the surfaces 730, 732, 734, and 736 may alternatively be employed as the active mopping surface of the mop.

Figure 11:
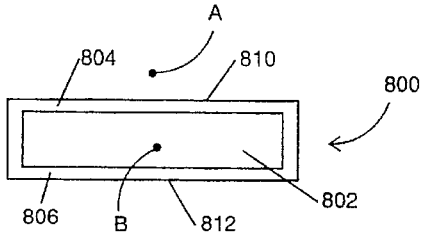
FIG. 11 is a schematic representation of a mop head according to another embodiment of the invention, showing the differing active mopping surfaces thereof.

FIG. 11 is a schematic representation of a mop head according to another embodiment of the invention, wherein the mop head 800 is of continuous character, defining a flattened-roll conformation in which the interior volume 802 is bounded by the top and bottom panels 804 and 806, respectively, and with the mount structure of the mop handle being reposable in the interior volume at locus B for subsequent coupling with an elongate shaft member of the mop handle disposed at locus A and extending through the top panel 804 into the interior volume of the mop head. By this arrangement, two distinct surfaces 810 and 812 are provided, with the mop head being invertable to deploy one or the other of these surfaces as the active mopping surface.

Figure 12:
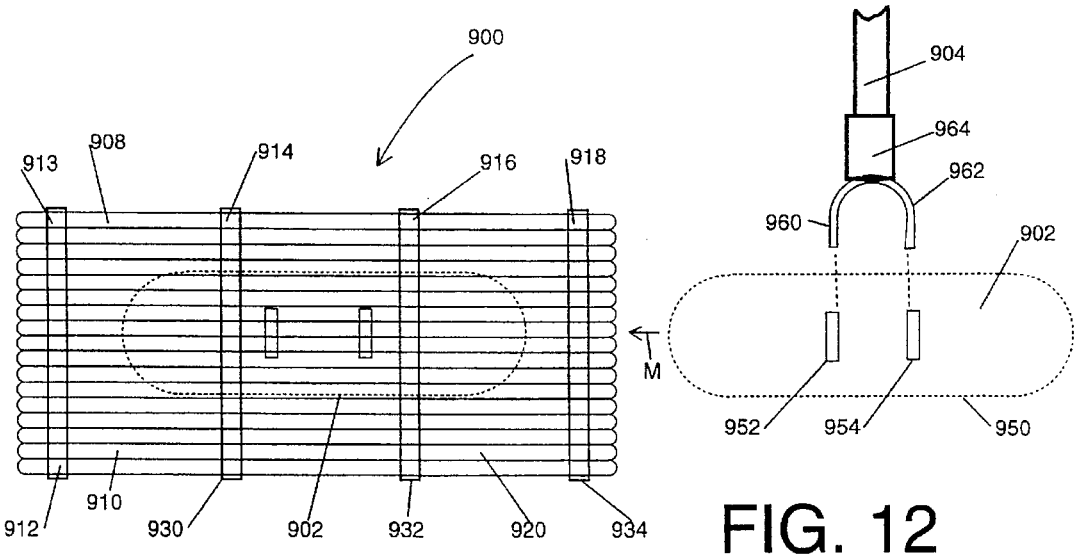
FIG. 12 is a top plan view of a mop head according to still another embodiment of the invention, with an associated mop handle platform assembly and elongate shaft member, assembleable to form a mop article in accordance with the present invention.

The schematic arrangement shown in FIG. 11 is also employed in the embodiment of FIG. 12, which is a top plan view of a mop head 900 according to still another embodiment of the invention, with an associated mop handle platform assembly 902 and elongate shaft member 904, assemblable to form a mop article in accordance with one embodiment of the present invention.

In the mop article arrangement of FIG. 12, the mop head 900 comprises an array 908 of elongate mop strand element 910 which are generally parallely arranged and connected to one another only by the securement members which comprise web strip elements 912, 914, 916, and 918.

In this embodiment, web strip element 912 is sewn by the double seam stitchings 913 to both top and bottom panels of the array, only the top panel 920 being visible in the plan view of FIG. 12.

By sewing the top and bottom panels together with seam stitchings 913 through the web strip element 912, a closed end of the interior volume is provided inside the superposed panels of the mop head 900.

Each of the other securement members (web strip elements 914, 916, and 918) are affixed to strand elements of the respective panels, with the web strip means circumscribing the superposed panels, but without the panels being connected together by such securement means at their respective inner facing surfaces, as is affected by the double seam stitchings 913 and web strip element 912. The web strip elements 914, 916, and 918 are fixedly attached to one another at their overlapped ends 930, 932, and 934, as shown.

By this arrangement, a closed end of the interior volume is provided between the top and bottom panels of mop head 900, while the top and bottom panels are otherwise separable over their medial portion in the plan view as shown, whereby the mounting platform 902 of the mop handle may be inserted into the interior volume of the mop head, between top and bottom panels thereof, by translation in the direction of arrow M shown in FIG. 12, so that the mop handle mount 902 is ultimately reposed in the interior volume between the respective top and bottom panels, as shown in dotted outline in the mop head portion of FIG. 12.

The mop handle mount 902 comprises a planar plate 950 having upwardly extending flanges 952 and 954 thereon. These flanges in turn are coupleable to prong elements 960 and 962 affixed by collar 964 to elongate shaft member 904 of the mop handle.

By the arrangement shown in FIG. 12, two separate and discrete active mopping surfaces are provided, analogous to the surfaces 810 and 812 shown in the schematic representation of mop head 800 in FIG. 11. Thus, the mop handle mount 902 may be disposed in either of two orientations within the interior volume of the mop head 900, so that one of the exterior surfaces of the top and bottom panels is selected for active mopping surface duty.

Figure 13:
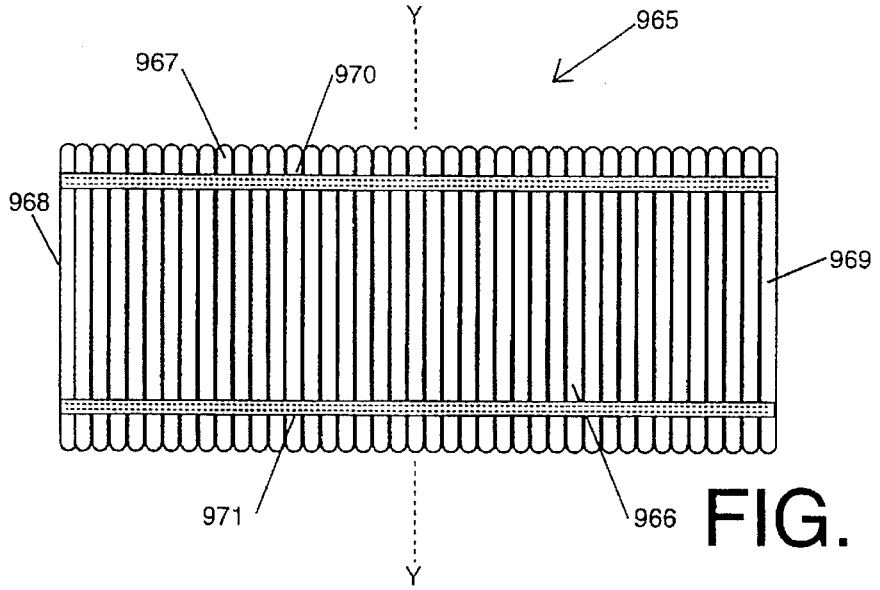
FIG. 13 is a top plan view of an extended length strand element array for forming a mop head according to another embodiment of the invention.

FIG. 13 is a top plan view of a mop head 965 according to another embodiment of the invention, comprising an array 966 of elongate strand elements 967 extending from a first end 968 to a second end 969 of the array, and secured in aggregate or unitary form by strand filament fasteners 970 and 971, arranged as shown. The fasteners may be piercingly stitched through the strand elements 967, or alternatively may be glued or otherwise affixed to the strand elements. The mop head of this embodiment is of continuous form and may be transversely folded at the fold line Y—Y to form a folded mop head structure as is shown in the mop head article of FIG. 14, wherein corresponding parts and elements are numbered correspondingly to FIG. 13.

Figure 14:
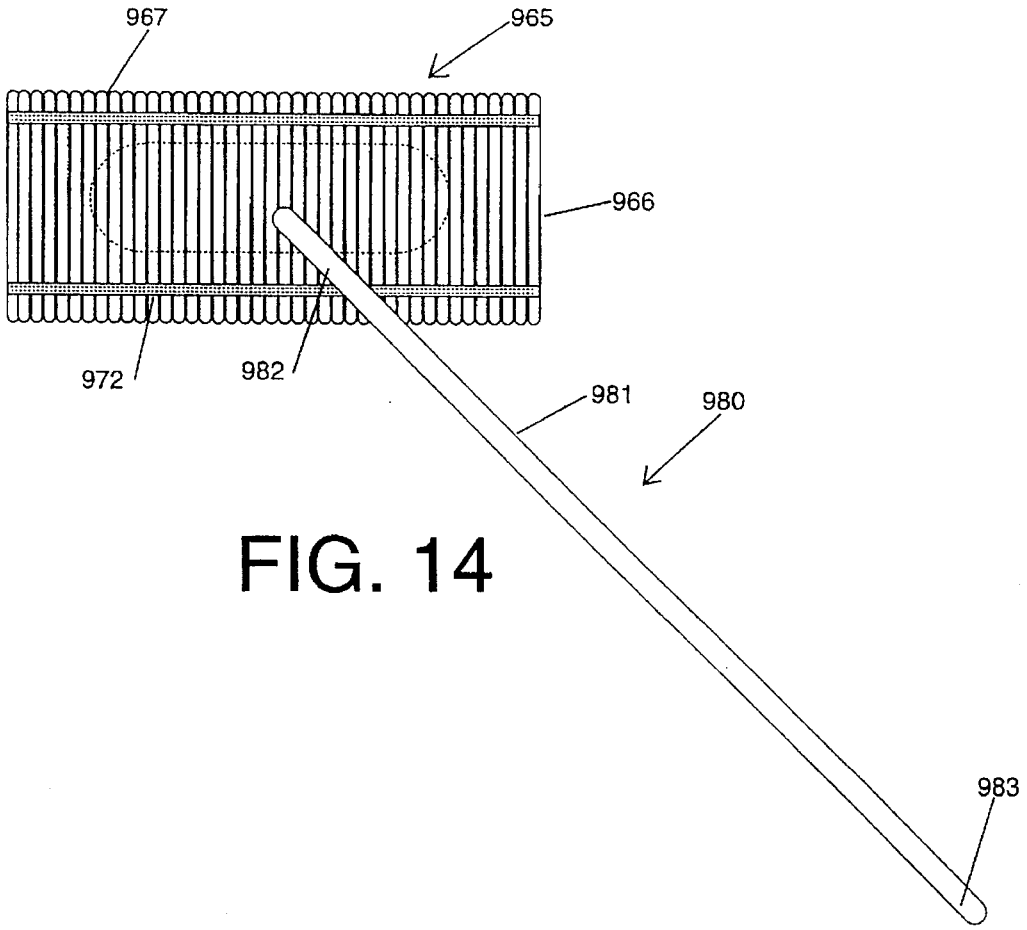
FIG. 14 is a top perspective view of a mop article comprising the strand element array of FIG. 13.

The mop head structure of FIG. 13 may be extended even beyond the length shown in the drawing, being formed as a continuous extended length stock material, and such material may be transversely severed at selected lengths to form a mop head portion which is foldable into a mop head body for use, as shown in FIG. 14.

The folded mop head body shown in FIG. 14 may have the resulting top and bottom panels coupled with one another in any suitable manner, as for example by interior matable hook and loop fastener components, mechanical fasteners, or tie members (not shown in FIG. 14). The mop head 965 comprises an interior volume in which the mop handle mount 972 is disposed, as shown in the dotted outline in the drawing. The mop handle mount 972 of mop handle 980 is joined to the lower portion 982 of elongate shaft member 981. The upper end 983 of shaft member 981 is manually grippable to facilitate use of the mop article in the conventional manner.

Figure 15:
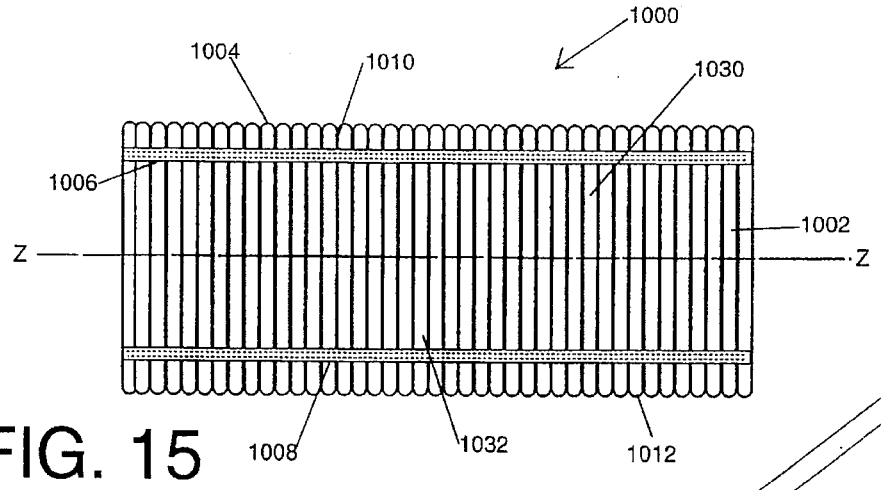
FIG. 15 is a high width, extended length strand element array which is longitudinally foldable to form a mop head body according to still another embodiment of the invention.

FIG. 15 is a plan view of another mop head 1000 according to a further embodiment of the invention. The mop head 1000 comprises a generally parallel array 1002 of elongate strand elements 1004 which are secured in array form by securement means 1006 and 1008, of a type as described hereinabove in the embodiment shown in FIGS. 13 and 14. The mop head array extends in the longitudinal direction of the elongate strand elements 1004 from a top edge 1010 to a lower edge 1012, as shown. Illustrated as transverse axis Z—Z is a fold line by means of which the half-sections 1030 and 1032 are superposable when the array is folded at such fold line, thereby forming respective top and bottom panels of the resulting mop head body.

Figure 16:
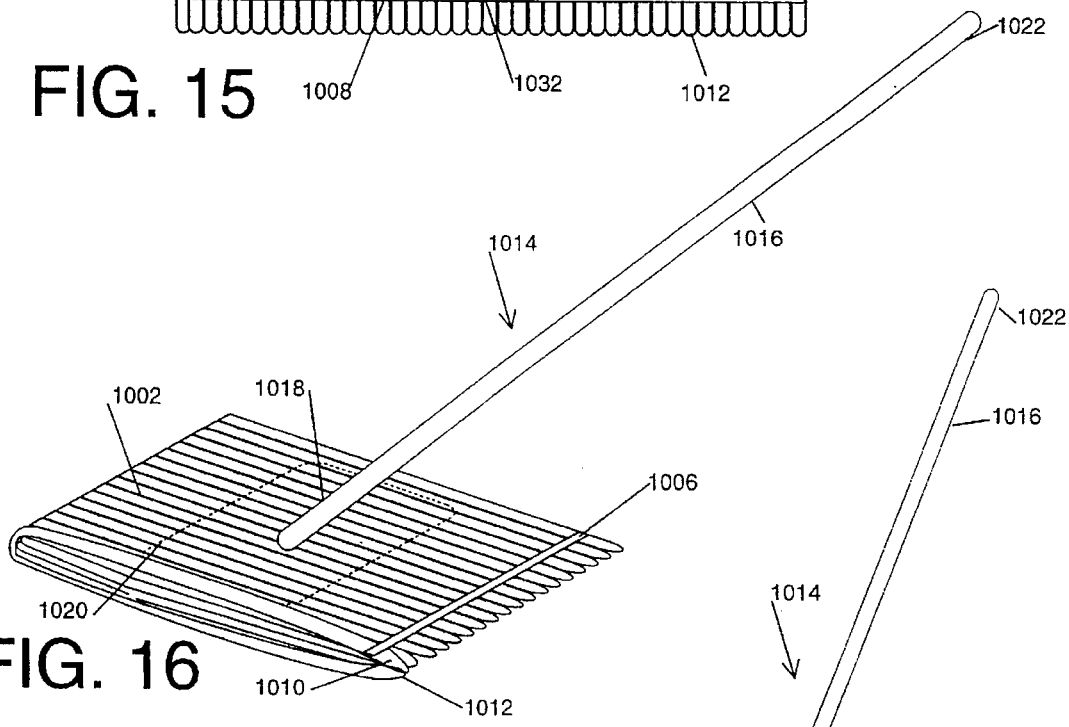
FIG. 16 is a mop article comprising a mop head body formed from the strand element array of FIG. 15.

FIG. 16 shows a perspective view of a mop article comprising the mop head of FIG. 15 in a folded conformation of the strand element array, with a lower portion 1018 of the elongate shaft member 1016 of the mop handle 1014 extending through strand elements of the strand element array 1002 and being connected to interior volume mop handle element 1020. The upper portion 1022 of the shaft member 1016 may then be manually grasped to effect use of the mop article. In this arrangement, the top edge 1010 and the bottom edge of the strand element array are in general registry, with half-section 1030 forming the top panel of the mop head body, and half-section 1032 forming the bottom panel of the mop head body, as shown in the side elevation view of FIG. 17, wherein corresponding parts and elements are numbered correspondingly with respect to FIGS. 15 and 16.

As an alternative to the use of a strand element array as is shown and described with respect to the preceding drawings of illustrative embodiments of the invention, the mop head body may comprise top and bottom panels formed of a looped woven material as in the embodiment shown in FIG. 18. In this embodiment, the mop head 1100 comprises a looped woven material 1102 defining top panel 1104 and bottom panel 1106 defining an interior volume therebetween in which the wire mount 1112 of mop handle 1108 may be disposed, as by lateral insertion into the interior volume through one of the two open ends of the mop head body. Subsequently, the shaft member 1110 of the mop handle 1108, which has been suitably disengaged from the wire mount prior to insertion of the mount into the interior volume of the mop head body, is thereupon rejoined to the wire mount, with the shaft member 1110 extending through the top panel of the mop head.

Figure 17:
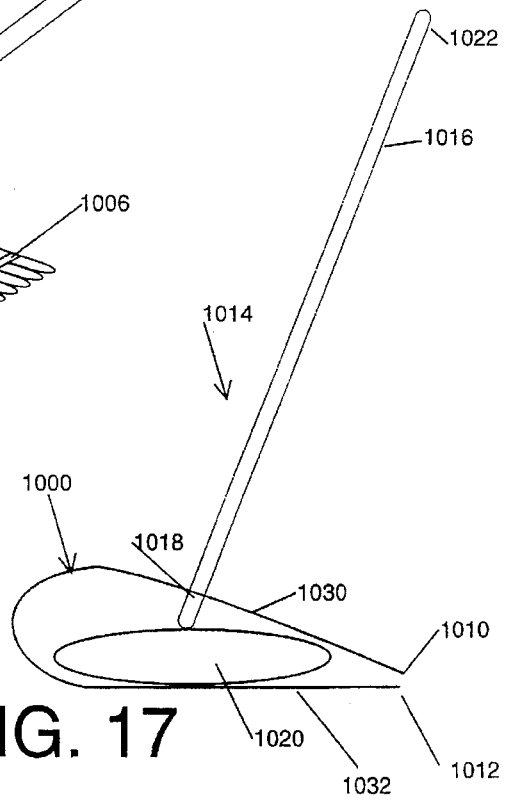
FIG. 17 is a side elevation view of the mop article of FIG. 16.

The mop head bodies shown in FIGS. 13–18 are reconfigurable to provide different active mopping surfaces. The mop head body of FIGS. 13 and 14 may be refolded in an opposite manner about the fold line Y—Y, and may also be inverted in each of such fold conformations, to yield a total of four different active mopping surfaces. The mop head body of FIGS. 15–17 is similarly reconfigurable to provide four discrete active mopping surfaces. The mop head body of FIG. 18 is inverable to provide two discrete active mopping surfaces.

FIG. 19 is a perspective view of a mop article according to another embodiment of the invention, including a mop head 1200 including a top panel 1206 with a top panel 1202 featuring tuft elements 1204 thereon, and a bottom panel 1208 which is similarly constructed of a tufted panel. The top and bottom panels are joined to one another as shown by a back connecting panel. On the front edge of the interior surface of the bottom panel is provided a first member 1210 of a hook and loop fastener system, with the front edge of the interior surface of the top panel featuring a corresponding matable fastener element of a complimentary character to the first member of the fastener system on the bottom panel 1208. In this manner, the front portions of the respective top and bottom panels of the mop head body may be separably joined to form an interior volume enclosing the plate element 1212 of the mop handle. Plate element 1212 features a threaded collar on its upper surface which is complementary to threaded surface 1220 of handle shaft 1218 when the shaft is passed through the opening 1216 of the top panel. The mop head body is invertable as well as evertable, to provide a total of four discrete active mopping surfaces in use of the mop head.

As an alternative to the tufted surface panels used in the mop head of FIG. 19, there may be employed mop head surfaces or panels of woven, e.g., knitted, or non-woven web materials. For example, the panels presenting the active mopping surfaces may comprise a knitted web or fabric material 1300 shown in FIG. 20, including generally perpendicular fibers or yarns 1302 and 1304. As another possible material, mop head panels formed of a braided conformation may be employed, as illustrated in FIG. 21. The braided material 1400 comprises individual strand elements 1402 bound by retention fibers 1404 into the unitary array which is shown.

Figure 22:
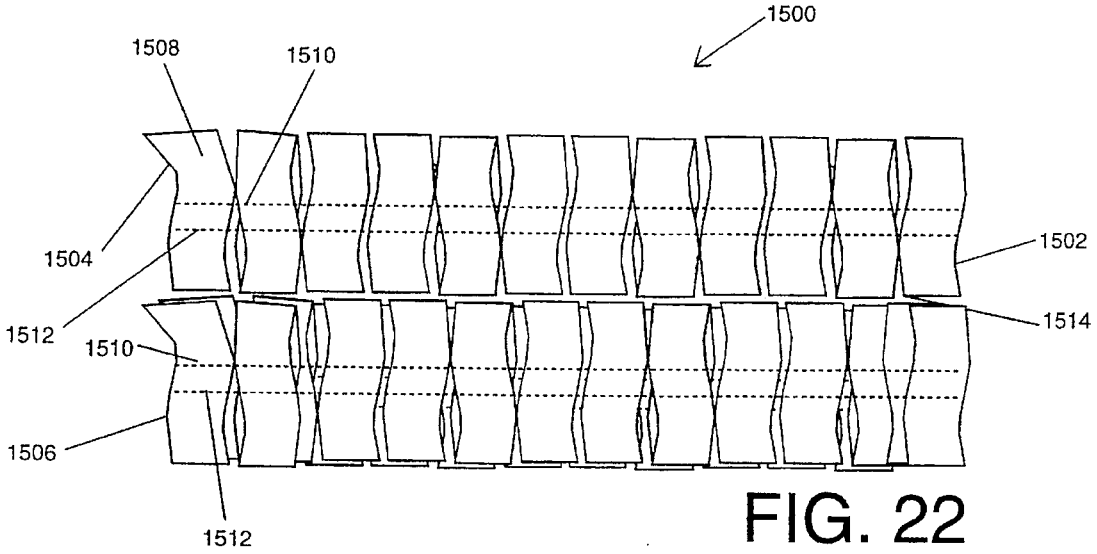
FIG. 22 is a bottom plan view of a mop head according to a further embodiment of the invention.

FIG. 22 is a bottom plan view of a mop head 1500 according to a further embodiment of the invention. This mop head 1500 comprises a mop head main body portion 1502 including elongate arrays 1504 and 1506 of strand elements 1508 which may be of suitable material such as non-woven or other fabric or fiber-based material. Each of the strand element arrays 1504 and 1506 is sewn by stitchings 1510 and 1512 to a backing sheet or web 1514 of suitable material.

Figure 23:
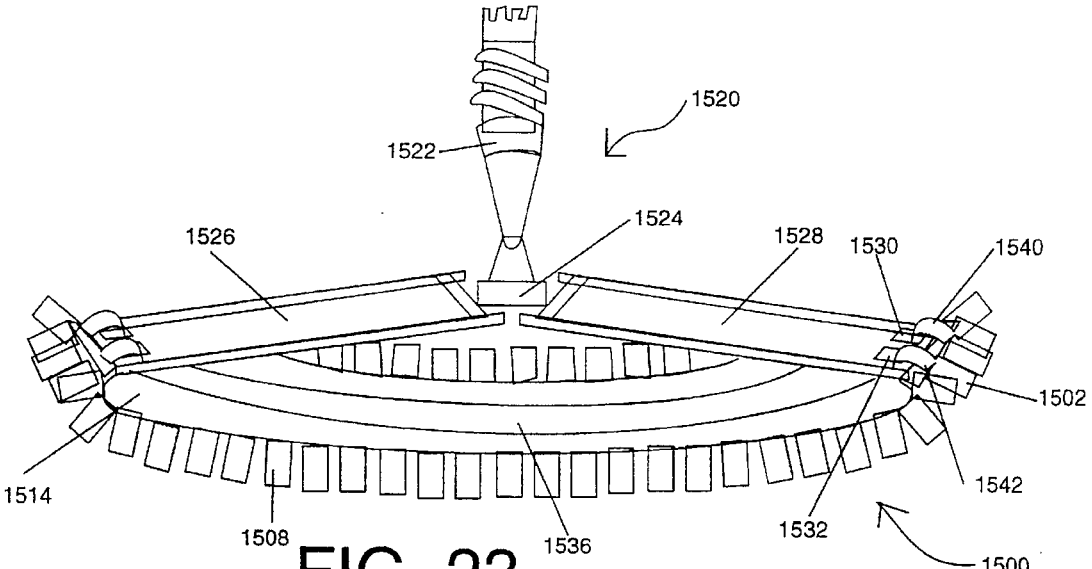
FIG. 23 is a perspective view of a portion of a mop, comprising the mop head of FIG. 22.

FIG. 23 is a perspective view of a portion of a mop 1520, comprising the mop head 1500 of FIG. 22, and wherein the corresponding parts and elements of FIG. 23 are numbered correspondingly with respect to FIG. 22. As shown, the mop head main body portion 1502 is arranged with the back surface 1536 of the backing sheet or web 1514 in facing relationship to the wing members 1526 and 1528 of the mop head securement assembly including transverse connector member 1524 joined to the inner portions of the wing members, and arranged with the collar 1522 of the assembly being constructed and arranged for attachment to a mop handle.

At their outer portions, the wing members 1526 and 1528 of the mop head securement assembly are provided with laterally side-by-side apertures 1530 and 1532 through which pass respective mop head securement elements 1540 and 1542. The mop head securement elements are affixed at one end to the longitudinal edge margins of the mop head 1500, and are for example provided with suitable hook and loop fastener mating surfaces on their opposite ends which are securingly matably engageable with recipient surface portions on the the back surface 1536 of the backing sheet or web 1514. In this manner, the right-hand outer part of the mop head main body portion 1502 is secured in coupled relationship with the right-hand wing member 1528 of the mop head securement assembly, and the left-hand outer part of the mop head main body portion 1502 is correspondingly secured in coupled relationship with the left-hand wing member 1526 of the mop head securement assembly.

In lieu of the hook and loop affixation means at the outer end of the mop head securement elements 1540 and 1542, there could be employed any other suitable coupling or affixation means for securing the mop head main body portion to the respective wing members of the securement assembly, such as mechanical fasteners, tie-and-eyelet means, low tack adhesive arrangements allowing ready attachment and detachment of the mop head main body portion in relation to the wing members of the securement assembly.

Figure 24:
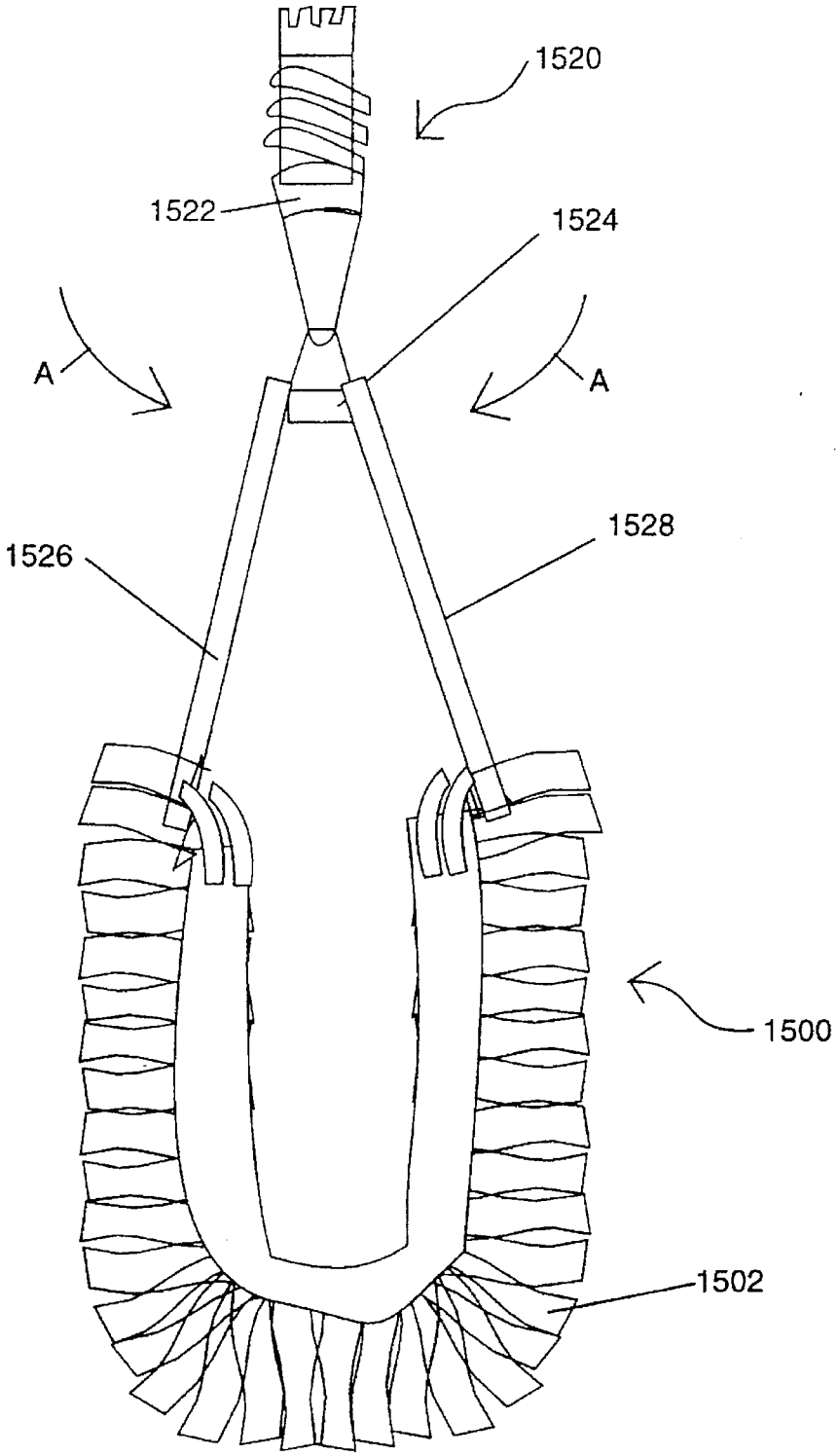
FIG. 24 is a perspective view of the portion of the mop as shown in FIG. 23, in a detensioned frame conformation.

The securement assembly of the mop 1520 is shown in FIG. 24 in a wringing position, wherein the collar 1522 has been actuated in relation to the transverse connector and the wing members 1526 and 1528 of the mop head securement assembly, e.g., by selective twisting, rotation, or depression of a mop handle (not shown in FIG. 24) to operate a releasable retention mechanism in the collar 1522 of the assembly, so that the wing members 1526 and 1528 are released from the extended and fixed position shown in FIG. 23, pivotally translating downwardly in the direction indicated by arrows A in FIG. 24, so that the mop head main body portion ultimately hangs down from the outer extremeties of the wing members (to which the outer longitudinal margins of the mop head are secured as shown in FIG. 23).

FIG. 24 thus is a perspective view of the mop as shown in FIG. 23, in a detensioned frame conformation. In such conformation, the mop head main body portion is amenable to wringing or squeezing, either manually or by use of a wringer or compression means (not shown), to release the liquid from the mop head, when the mop is used for wet mopping applications. Such conformation is also useful for removal of previously taken-up particulates when the mop is used in dry mopping applications, or for application of material(s) to be transferred by the mop to a floor when the mop is used as an applicator, e.g., for waxing applications.

As an alternative to the provision of a selectively actuatable release/locking mechanism in the collar 1522 of the mop head securement assembly, the wing members 1526 and 1528 may simply be formed and secured to the transverse connector member 1524 by "snap-lock" means by which the wing members are biased to the position shown in FIG. 23 and snap into such position when the wing members approach such position from the detensioned conformation shown in FIG. 24, and which detension upon exertion of pressure on the wing members (such as may be applied in use by a hand or foot exerting downward pressure on the upper surfaces of the wing members) translating the wing members in the direction indicated by arrows A, beyond the biased snap-locking limit, so that the wing members then drop to the position shown in FIG. 24.

Figure 25:
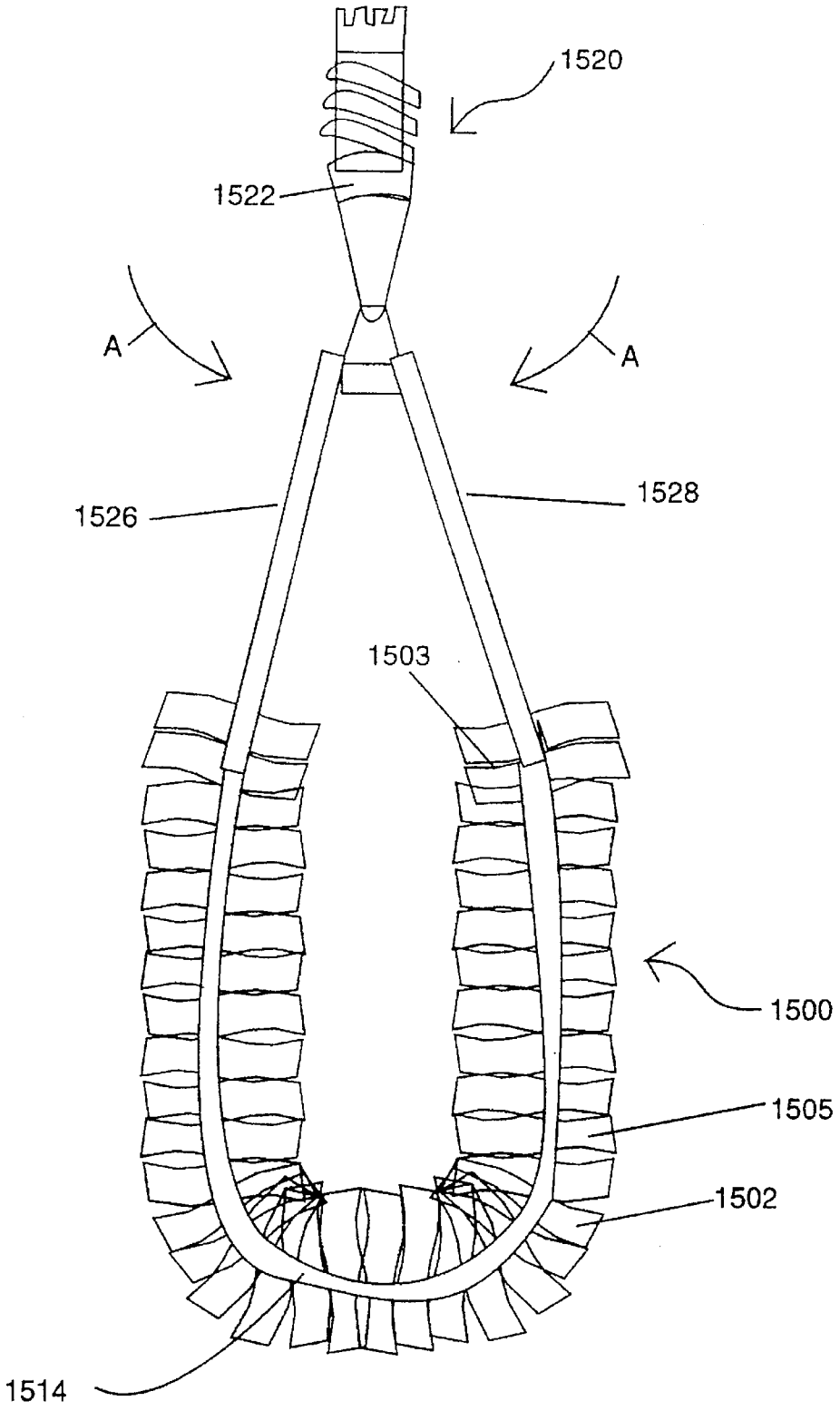
FIG. 25 is a perspective view of a portion of another mop comprising a reversible mop head body according to another embodiment of the invention.

FIG. 25 is a perspective view of a portion of a mop 1520 comprising a mop head 1500 with a reversible mop head body according to another embodiment of the invention, and wherein the corresponding parts and elements of FIG. 25 are numbered correspondingly with respect to FIG. 24. In this embodiment, the mop head main body portion 1502 has a first array 1503 of strand elements, on a first (back) side of the backing web or sheet 1514, and a second array 1505 of strand elements on a second (front) side of the backing web or sheet, so that the mop head main body portion is selectively reversible to provide two discrete mop head faces, by the simple expedient of uncoupling the securement elements 1540 and 1542 (see FIG. 23) at the outer longitudinal margins of the mop head main body portion, and everting the mop head main body portion in relation to the position shown in FIG. 25.

Figure 26:
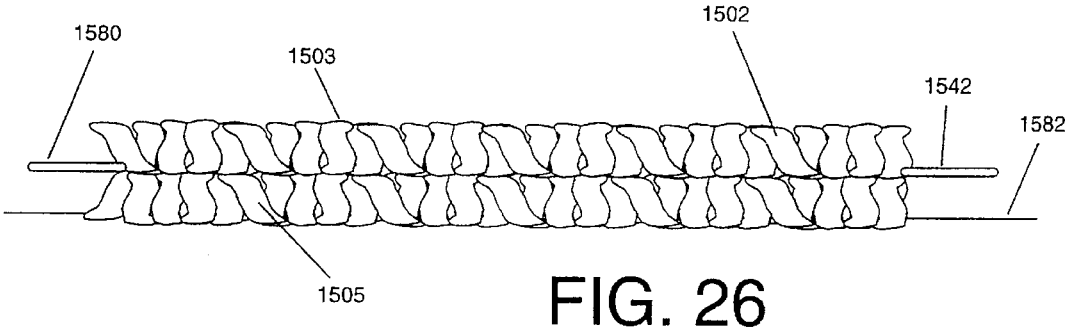
FIG. 26 is an edge elevation view of the mop head body of the mop shown in FIG. 25.

By such eversion and reversal, with corresponding recoupling of the securement elements in the everted position, the first array 1503 of strand elements is then arranged on the front side of the backing web or sheet 1514, and a second array 1505 of strand elements is then arranged on the back side of the backing web or sheet FIG. 26 is an edge elevation view of the mop head body of the mop shown in FIG. 25, wherein the parts and elements are correspondingly numbered. The mop head main body portion 1502 comprising the respective arrays 1503, 1505 of strand elements is shown as reposed on a flat supportive surface 1582, and with the securement elements 1542 and 1580 (for securing the mop head main body portion to the extremeties of the wing members of the securement assembly, as shown in FIG. 23) illustrated as outwardly extending from the mop head main body portion 1502.

Figure 27:
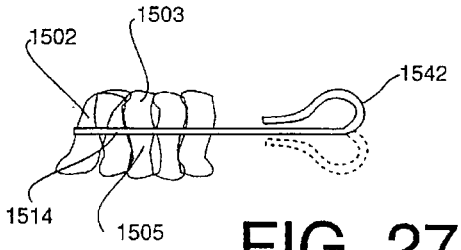
FIG. 27 is an edge elevation view of an end portion of the mop head body of FIG. 26, showing the reversible fastener element thereof.

FIG. 27 is an edge elevation view of an end portion of the mop head main body portion 1502 of FIG. 26, showing the reversible securement element 1542 thereof. The mop head main body portion comprises the arrays 1503 and 1505 of strand elements secured to the backing web or member 1514, which also has the securement element 1542 affixed thereto.

The outer free end of the securement element 1542 is shown looped back onto the top surface of the element, with the resultingly contacting (contiguous) areas of the securement element being suitably provided with hook and loop fastener components, self-adhesive means, or other selectively disengageable structure by means of which the mop head main body portion can be secured to the wing members of the securement assembly of a mop as shown in FIG. 23.

Shown in dotted line representation in FIG. 27 is the outer free end of the securement element 1542, as looped back onto the bottom surface of the element, with the resultingly contacting (contiguous) areas of the securement element being suitably provided with hook and loop fastener components, self-adhesive means, etc., as described in the preceding paragraph. By this top surface/bottom surface selective affixation structure of the securement element 1542, the corresponding mop head main body portion may be readily selectively everted and repositioned in use thereof.

In lieu of the specific securement elements 1542 shown, it will be recognized that the mop head main body portion may be alternatively configured, with clips or other affixation or coupling structure at the end segments (longitudinal extremeties) of the mop head main body portion, for mounting of the mop head main body portion on the mop support structure associated with the handle of the mop.

Correspondingly, the wing member assembly shown in FIGS. 23–25 may be replaced or substituted with any other suitable means, such as for example a wire frame support, which is of segmented form, and associated with actuatable means (such as a push button, release/lock lever, etc.) for selectively holding the wire frame support in an extended conformation for mopping use, and for selectively releasing the segments from their extended conformation, so that they drop in a manner generally analogous to that shown in FIGS. 23 and 24, for the wing member assembly. The mop head main body portion will then hang down below the collapsed frame, so that the mop head main body portion can be, for example, dipped into a mop bucket containing wash or cleaning solution, and subsequently wrung out.

Such frame, after wringing out of the mop head main body portion, can then be flattened back to a fixed, active extended position, by pressing the frame downwardly on the floor surface.

Such collapsable frame mop structures, of the general type of which a specific embodiment is shown in FIGS. 23–25, afford significant benefits in use, including good absorption and release of liquids, and good solids mopping and applicator characteristics, particularly when high capacity sorptive strand elements (e.g., of non-woven wood pulp/polymer fiber materials) are employed in the mop head main body portion strand arrays (conventional mop yarns, by contrast, afford substantially lower pick-up, retention, and release capacity, releasing only low levels of previously taken-up liquid and remaining very wet once exposed to liquid; by contrast, a collapsable frame wringable mop of the present invention, utilizing such high capacity arrays of sorptive strand elements, are wringable to remove over 50% of liquid subsequent to wetting of the mop head).

The invention, while illustratively shown and described herein as embodied in a mop head structure, may alternatively be utilized without the mop handle means, to constitute other articles such as mats, socks, booms, and pillows, to pick up, retain, and selectively release fluids and/or particulates, or other materials. Further, while the invention has been described with reference to mopping involving removal of selected substances such as dust or spilled liquids, it will be appreciated that the invention may be employed for application of selected materials to a surface, object, or other physical location, such as the application of liquid or paste waxes to wooden floors.

While the invention has been shown in described with respect to illustrative embodiments, aspects, and features, it will be recognized that numerous embodiments, variations, and modifications are possible within the broad scope of the present invention, and all such embodiments, modifications, and variations are therefore to be regarded as being within the spirit and scope of the invention.

What is claimed is:

1. A polysurfacial mop head suitable for use with a mop handle including a generally planar mounting assembly at an extremity thereof for mounting of the mop head thereon, comprising:

a generally parallelly aligned array of elongate strand elements secured by multiple securement members to form a unitary mop head body of generally flat character when reposed on a planar supporting surface, with the securement members constructed and arranged to retain the unitary mop head body in position forming an interior volume bounded by first and second generally flat panels of the mop head body wherein the first panel has a first exterior mopping surface and the second panel has a second exterior mopping surface, with the mop head body being constructed and arranged for (i) positioning of the mop handle mounting assembly in the interior volume of the mop head body in a selected one of opposite orientations, including a first orientation wherein the mounting assembly is coupleable with the mop handle when the mop handle is extended through the strand elements of the first panel for coupling therewith, and a second orientation wherein the mounting assembly is coupleable with the mop handle when the mop handle is extended through the strand elements of the second panel for coupling therewith, and (ii) positioning of the mop head body a selected one of opposite positions, including a first position wherein the mop handle mounting assembly is positioned in the interior volume of the mop head body in said first orientation and the second exterior mopping surface is presented to said planar supporting surface, and a second position wherein the mop handle mounting assembly is positioned in the interior volume of the mop head body in said second orientation opposite the first orientation, so that the first exterior mopping surface is presented to said planar supporting surface, and wherein the change of the exterior mopping surface presented to the planar supporting surface requires uncoupling of the mop handle from the mop handle mounting assembly, inverting of the mounting assembly in the interior volume of the mop head body, and recoupling of the mop handle to the mounting assembly in the inverted orientation of the mounting assembly.

2. A mop head according to claim 1, wherein the securement members comprise web strip elements which are generally perpendicularly oriented in relation to the longitudinal direction of the elongate strand elements of the mop head array.

3. A mop head according to claim 2, wherein the strand elements are secured to the web strip elements, and wherein the web strip elements are in spaced-apart relationship to one another.

4. A mop head according to claim 2, wherein the strand elements are sewn to the web strip elements.

5. A mop head according to claim 2, wherein the web strip elements extend transversely outwardly from the mop head body to define free ends interconnectible with one another to form the unitary mop head body.

6. A mop head according to claim 5, wherein the web strip element free ends are interconnectible by tying thereof together.

7. A mop head according to claim 5, wherein the web strip element free ends are interconnectible by means of respective matable mechanical fasteners at said free ends.

8. A mop head according to claim 5, wherein the web strip element free ends are interconnectible by means of respective hook and loop contact fasteners at said free ends.

9. A mop head according to claim 5, wherein the web strip element free ends are interconnectible with one another such that when said free ends of the web strip elements are interconnected, opposite transverse outer margins of the elongate strand element array are in transverse proximity with one another such that the proximate transverse outer margins corporately form one of said panels of the unitary mop body, and a remaining transverse medial portion of the elongate strand element array forms the other panel of the unitary mop body.

10. A mop head according to claim 3, wherein the unitary mop body first and second panels are interconnected by transversely extending web strip elements including a first web strip element at a first end of the elongate strand element array and sewn along the full length thereof to the elongate strand elements of the first and second panels.

11. A mop head according to claim 10, wherein the first web strip element circumscribes the unitary mop body, in contact with external top and bottom surfaces of the respective first and second panels.

12. A mop head according to claim 10, wherein the web strip elements have matably engageable fasteners thereon, permitting extremeties of each of the web strip elements to be selectively matably engaged with one another.

13. A mop head according to claim 10, further including a second web strip element at a second end of the elongate strand element array and sewn along the full length thereof to the elongate strand elements of the first and second panels.

14. A mop head according to claim 13, wherein the second web strip element circumscribes the unitary mop head body, in contact with external top and bottom surfaces of the respective first and second panels.

15. A mop head according to claim 12, further including a second web strip element at a second end of the elongate strand element array and sewn along the full length thereof to the elongate strand elements of the first and second panels, wherein the second web strip element is sewn such that the first and second panels are sewn together to define a closed second end of the interior volume of the unitary mop head body, whereby the generally planar mounting assembly of the mop handle may be inserted between elongate strand elements of the unitary mop head body into the interior volume of the unitary mop head body.

16. A mop head according to claim 12, further including a generally planar platform assembly selectively joinable at one end thereof to the mop handle, and said mop head further including a second web strip element at a second end of the elongate strand element array and sewn along the full length thereof to the elongate strand elements of the first and second panels, but with the first and second panels being separable at said second end of the elongate strand array to allow ingress by the generally planar mounting assembly of the mop handle into the interior volume of the unitary mop head body, and with at least one intermediate web strip element positioned circumscribingly about the unitary mop head body between the first and second ends thereof and sewn along the full length thereof to the elongate strand elements of the first and second panels, but with the first and second panels being separable between the first and second ends to allow longitudinal passage of the generally planar platform assembly in the interior volume subsequent to ingress of the generally planar platform assembly into the interior volume such that the generally planar platform assembly is wholly reposable in the interior volume, with the mop handle being insertable between elongate strand elements.

17. A mop head according to claim 1, wherein the securement members comprise sewn stitchings.

18. A mop head according to claim 1, wherein the securement members comprise bondant medium deposits, interbonding elongate strand elements to one another.

19. A mop head according to claim 1, wherein the elongate strand elements are treated with a treatment agent selected from the group consisting of antistatic agents, particulate pick-up enhancement materials, fluid pick-up enhancement materials, and mixtures thereof.

20. A mop head according to claim 1, wherein the unitary mop head body is evertable by disengagement of said securement members and resecurement thereof, to internalize the first and second exterior mopping surfaces, and exteriorly present top and bottom panel surfaces.

21. A mop article comprising:

a mop handle including an elongate shaft member with first and second ends, being manually grippable at the first end thereof, and a generally planar mounting assembly constructed and arranged for mounting of a mop head thereon, and selectively joinable to the elongate shaft member at the second end thereof; and a generally parallelly aligned array of elongate strand elements transversely secured by multiple securement members to form a unitary mop head body of generally flat character when reposed on a planar supporting surface, with the securement members constructed and arranged to retain the unitary mop head body in position forming an interior volume bounded by top and bottom panels of the mop head body wherein each panel defines multiple surface portions and comprises a transverse partial width portion of the strand element array, with the securement members constructed and arranged to allow (i) insertion of the mop handle mounting assembly into the interior volume of the mop head body and (ii) securement therein by means of at least one of the securement members, with each of the mop head body panels presenting active mopping surfaces and wherein the mop head body is securable on the planar mounting assembly of the mop handle in at least two differing deployment orientations with the selected active mopping surface presented to said planar supporting surface comprising differing panel surface portions in the different deployment orientations of the mop head body.

* * * * *